US010727555B2

(12) United States Patent
Hendry

(10) Patent No.: US 10,727,555 B2
(45) Date of Patent: Jul. 28, 2020

(54) MULTI-FILTENNA SYSTEM

(71) Applicant: NOKIA TECHNOLOGIES OY, Espoo (FI)

(72) Inventor: David Hendry, New Providence, NJ (US)

(73) Assignee: NOKIA TECHNOLOGIES OY, Espoo (FI)

( * ) Notice: Subject to any disclaimer, the term of this patent is extended or adjusted under 35 U.S.C. 154(b) by 89 days.

(21) Appl. No.: 15/925,180

(22) Filed: Mar. 19, 2018

(65) Prior Publication Data

US 2019/0288360 A1 Sep. 19, 2019

(51) Int. Cl.

| | |
|---|---|
| ***H01P 1/207*** | (2006.01) |
| ***H01P 7/06*** | (2006.01) |
| ***H01Q 13/06*** | (2006.01) |
| ***H01Q 21/06*** | (2006.01) |
| ***H01P 1/208*** | (2006.01) |
| *H01Q 21/00* | (2006.01) |

(52) U.S. Cl.

CPC ..... *H01P 1/207* (2013.01); *H01P 1/208* (2013.01); *H01P 7/06* (2013.01); *H01Q 13/06* (2013.01); *H01Q 21/06* (2013.01); *H01Q 21/061* (2013.01); *H01Q 21/0093* (2013.01)

(58) Field of Classification Search

CPC ..... H01P 1/207; H01P 7/06; H01Q 13/06; H01Q 21/061

See application file for complete search history.

(56) References Cited

U.S. PATENT DOCUMENTS 5,517,203 A * 5/1996 Fiedziuszko ..... H01P 1/2086 333/202
5,623,269 A * 4/1997 Hirshfield ..... H01Q 1/288 342/354

(Continued)

FOREIGN PATENT DOCUMENTS

| | | | |
|---|---|---|---|
| CN | 107369899 | A | 11/2017 |
| CN | 107425272 | A | 12/2017 |
| WO | WO 2018/077611 | A1 | 5/2018 |

OTHER PUBLICATIONS

Boccia, L et al., Multilayer Antenna-Filter Antenna for Beam-Steering Transmit-Array Applications , (dated Jul. 6-11, 2014), pp. 1-4.

(Continued)

*Primary Examiner* — Dameon E Levi
*Assistant Examiner* — David E Lotter
(74) *Attorney, Agent, or Firm* — Alston & Bird LLP

(57) ABSTRACT

A multi-filtenna system is provided that effectively combines an antenna element and a filter element in a compact design while concurrently providing adequate port isolation, a low ECC, a low insertion loss (and a corresponding high efficiency) and a similar radiation pattern for each antenna element in order to allow for multi-channel beam forming. A multi-filtenna system includes a plurality of filtennas disposed in parallel proximate one another. Each filtenna includes a port, one or more resonator sections coupled to one another and a radiating resonator. The one or more resonator sections are disposed between the port and the radiating resonator. Each of the plurality of filtennas are configured to communicate via the port and to operate at the same frequency.

20 Claims, 25 Drawing Sheets

(56) References Cited

U.S. PATENT DOCUMENTS

| | | | | |
|---|---|---|---|---|
| 2004/0072542 | A1 | 4/2004 | Sanford | |
| 2004/0072549 | A1 | 4/2004 | Sanford | |
| 2004/0072551 | A1 | 4/2004 | Sanford | |
| 2009/0295504 | A1* | 12/2009 | Andreasson | H01P 1/205 333/176 |
| 2014/0118206 | A1 | 5/2014 | Hendry et al. | |
| 2014/0198004 | A1 | 7/2014 | Richards et al. | |
| 2015/0054709 | A1 | 2/2015 | Tawk et al. | |
| 2018/0123255 | A1* | 5/2018 | Hendry | H01Q 1/36 |

OTHER PUBLICATIONS

Cifola, L., "Design of an Active Array Filtenna for Radar Applications", (dated Jul. 6-11, 2014) pp. 1644-1645.

Tao Li, W et al., Novel Printed Filtenna with Dual Notches and Good Out-of-band Characteristics for UWM-MIMO Applications, (dated Sep. 8, 2016), pp. 765-767.

Extended European Search Report for Application No. EP 19 16 3650.5 dated Aug. 23, 2019, 8 pages.

Mahmud, R.H. et al., *High-Gain and Wide-Bandwith Filtering Planar Antenna Array-Based Solely on Resonators*, IEEE Transactions on Antennas and Propagation, vol. 65, No. 5 (May 2017) 2367-2375.

* cited by examiner

MULTI-FILTENNA SYSTEM

TECHNOLOGICAL FIELD

An example embodiment relates generally to multi-filtenna systems and, more particularly, to a multi-filtenna system having a plurality of proximately located filtennas operating at the same frequency.

BACKGROUND

An antenna in a transmitting configuration transforms electronic signals, such as the electronic signals received from a radio, into electromagnetic signals for propagation through the air. Conversely, an antenna in a receiving configuration receives electromagnetic waves from the air and transforms the electromagnetic waves into electronic signals, such as for provision to a radio. A band pass filter is generally required to be disposed in series with an antenna to permit only desired signal frequencies to pass therethrough. The antenna and the band pass filter are generally physically separate from one another and connected by a transmission line, for example, a 50 ohm transmission line.

An antenna array generally includes dual-polarized antenna elements positioned with a half-wavelength spacing. Each polarization of the dual-polarized antenna elements of an antenna array allows an independent channel to be transmitted and received, thereby effectively doubling the bandwidth of the antenna array. A fully active antenna array having multiple antenna elements with half wavelength spacing can provide fully digital beam forming along with multiple input multiple output (MIMO) functionality. In this scenario, the fully active antenna array may include multiple independent antenna elements with half wavelength spacing to increase the capacity of the antenna array. However, a band pass filter is still required for each of the multiplicity of antenna elements of the fully active antenna array.

As such, a multi-mode antenna includes a plurality of antenna elements, each having a respective band pass filter with a half wavelength spacing between the antenna elements, thereby imposing a requirement for a substantial number of band pass filters in some circumstances. However, the provision of a plurality of antenna elements with their respective band pass filters with a half wavelength spacing may be challenging, particularly when endeavoring to concurrently maintain adequate port isolation, a low envelope correlation coefficient (ECC), a low insertion loss (and a corresponding high efficiency) and a similar radiation pattern for each antenna element in order to allow for multi-channel beam forming.

BRIEF SUMMARY

A multi-filtenna system is provided in accordance with an example embodiment that effectively combines an antenna element and a filter element in a compact design while concurrently providing adequate port isolation, a low ECC, a low insertion loss (and a corresponding high efficiency) and a similar radiation pattern for each antenna element in order to allow for multi-channel beam forming. As a result, the multi-filtenna system of an example embodiment offers performance advantages while effectively combining the antenna elements and the filter elements.

In an example embodiment, a multi-filtenna system is provided that comprises a plurality of filtennas disposed in parallel proximate one another. At least one filtenna comprises a port, one or more resonator sections coupled to one another and a radiating resonator. The one or more resonator sections are disposed between the port and the radiating resonator. The plurality of filtennas are configured to communicate via the respective port and to operate at the same frequency.

At least one resonator section of an example embodiment includes a waveguide section that defines a cavity therethrough and a resonator adjacent to the waveguide section. In an example embodiment, the resonator sections are stacked such that the cavities defined by the waveguide sections are at least partially aligned. At least one filtenna of an example embodiment also comprises a base defining the port proximate one end of the one or more resonator sections, opposite the radiating resonator. In this example embodiment, the at least one filtenna may also comprise an antenna element disposed proximate the radiating resonator, opposite the base relative to the one or more resonator sections. The antenna element may be, for example, aligned with a center portion of the radiating resonator. In an example embodiment, the at least one filtenna further comprises a ground wall element defining an opening surrounding the resonators of respective resonator sections of the plurality of filtennas and configured to be grounded. The ground wall element is disposed opposite the base relative to the resonators of the respective resonator sections.

The cavity defined by at least one respective waveguide section of the plurality of filtennas may be merged by a cutout section to define a common cavity. In an example embodiment, the cavities defined by the waveguide sections of at least one of the plurality of filtennas have a circular shape or a polygonal shape. In an example embodiment, for a respective resonator section of the plurality of filtennas, a first monolithic sheet defines the cavities of the waveguide sections for the plurality of filtennas and a second monolithic sheet defines the resonators for the plurality of filtennas. The plurality of filtennas of an example embodiment are disposed in a parallel relationship.

In another example embodiment, a multi-filtenna system comprises a plurality of filtennas disposed in parallel proximate one another. At least one filtenna comprises a plurality of resonator sections. At least one resonator section comprises a waveguide section defining a cavity therethrough and a resonator adjacent to the waveguide section. The resonator sections are stacked such that the cavities defined by the waveguide sections are at least partially aligned. The plurality of filtennas are configured to operate at the same frequency.

At least one filtenna of an example embodiment also comprises a base defining a port disposed proximate one end of the plurality of resonator sections. The at least one filtenna of this example embodiment may also comprise a radiating resonator disposed proximate an opposite end of the plurality of resonator sections relative to the base. Further, the at least one filtenna of this example embodiment also comprises an antenna element disposed proximate the radiating resonator, opposite the base relative to the plurality of resonator sections. The antenna element may be aligned, for example, with a center portion of the radiating resonator. At least one filtenna of an example embodiment also comprises a ground wall element defining an opening surrounding the resonators of respective resonator sections of the plurality of filtennas and configured to be grounded. The ground wall element is disposed opposite the base relative to the resonators of the respective resonator sections.

The cavity defined by at least one respective waveguide section of the plurality filtennas of an example embodiment are merged by a cutout section to define a common cavity.

The cavities defined by the waveguide sections of the plurality of filtennas of an example embodiment have a circular shape or a polygonal shape. In an example embodiment, for a respective resonator section of the plurality of filtennas, a first monolithic sheet defines the cavities of the waveguide sections for the plurality of filtennas and a second monolithic section defines the resonators for the plurality of filtennas.

BRIEF DESCRIPTION OF THE DRAWINGS

Figure 1:
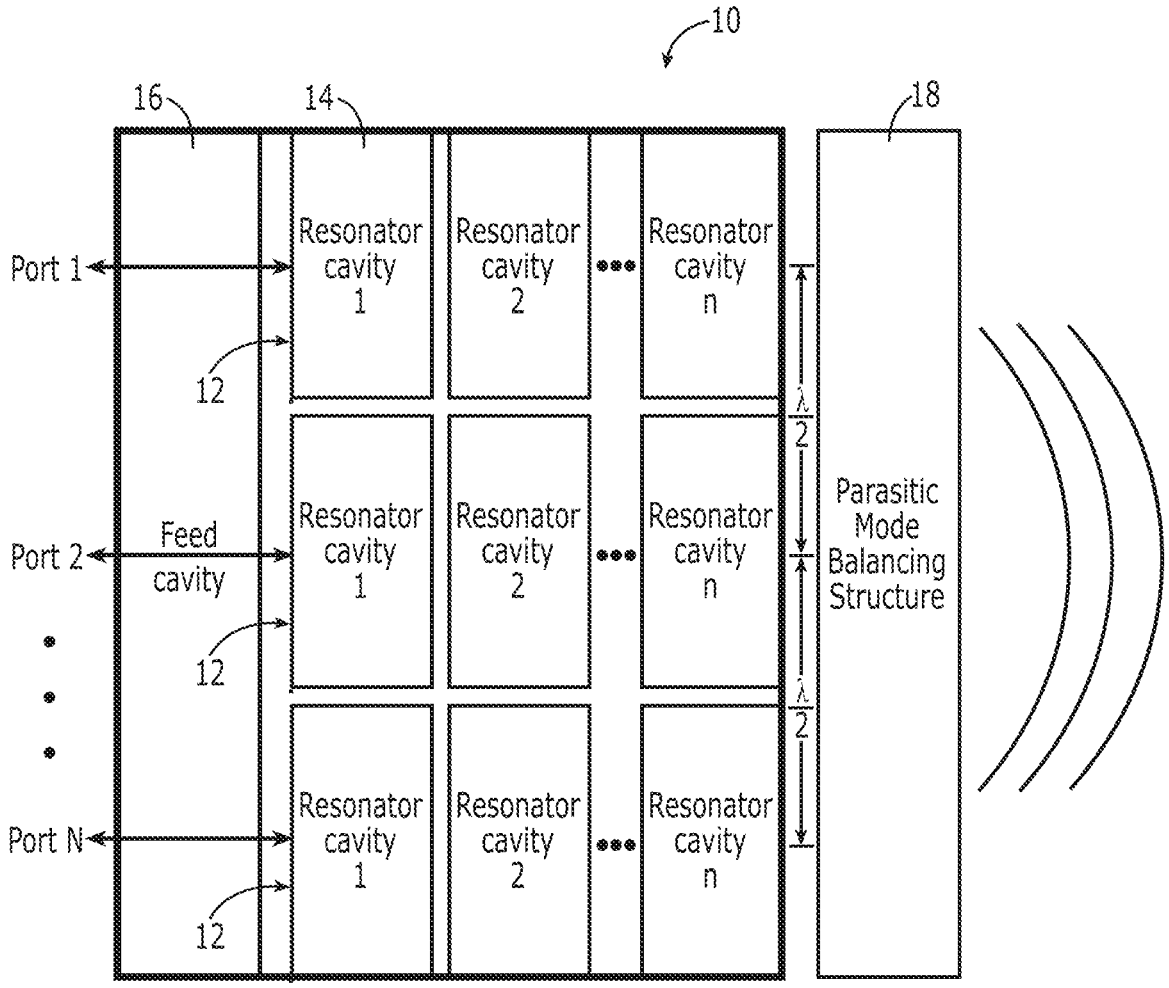
Figure 2:
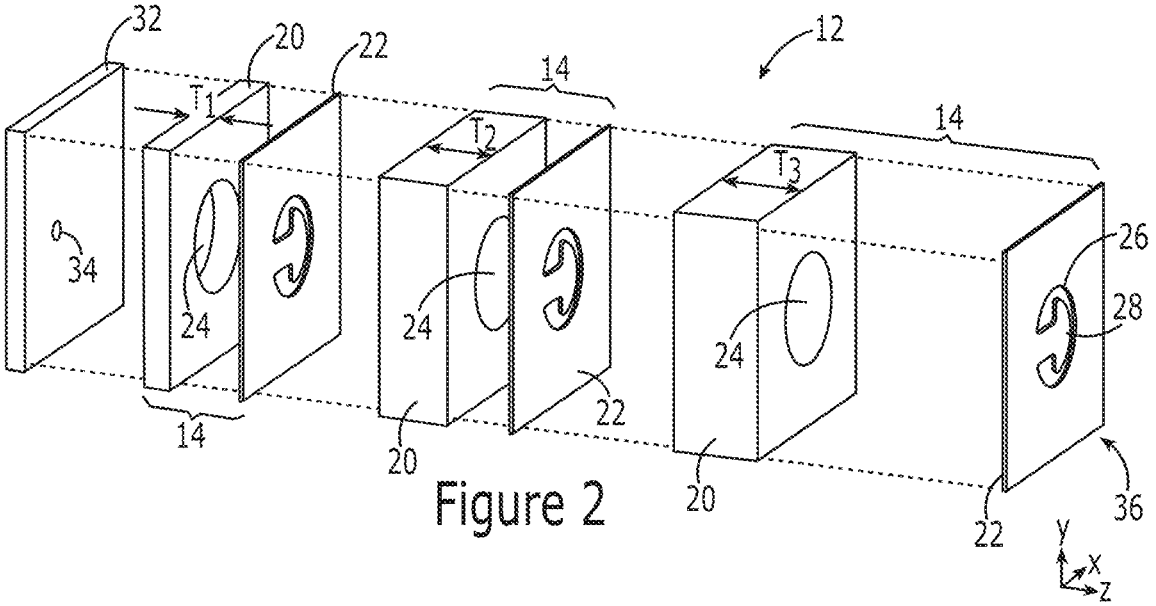
Figure 3:
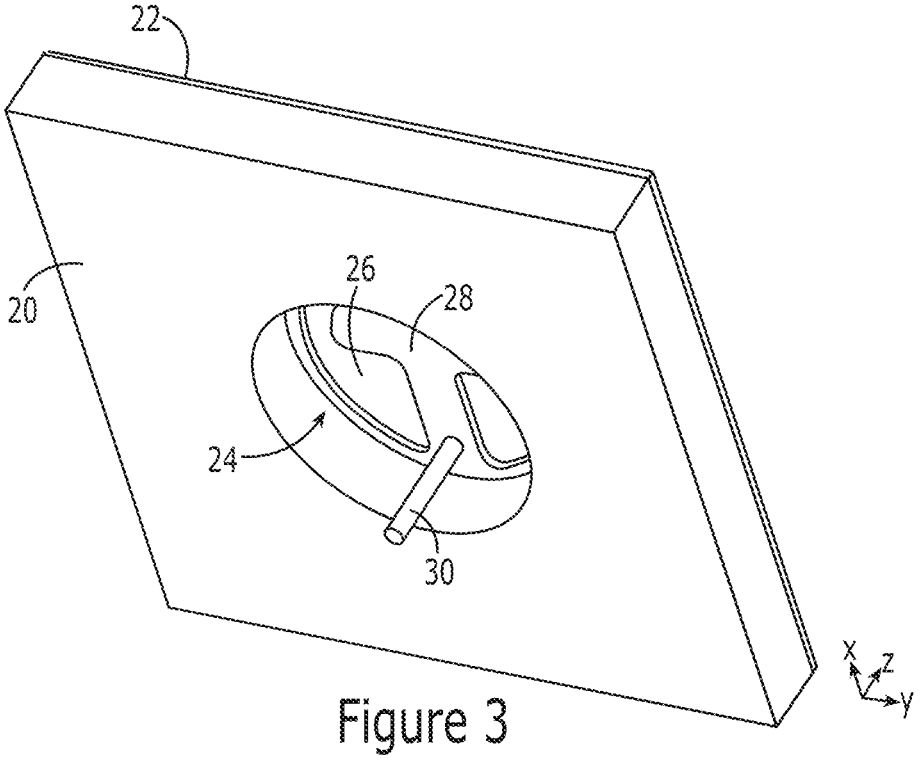
Figure 4:
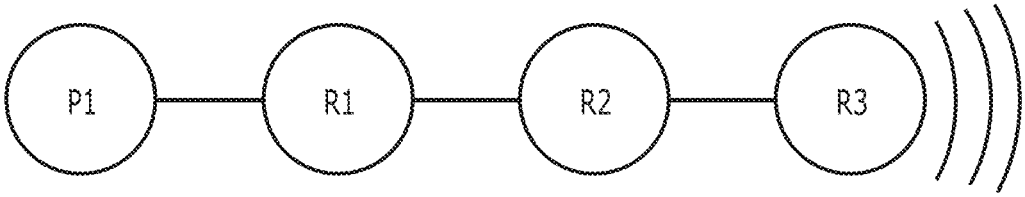
Figure 5:
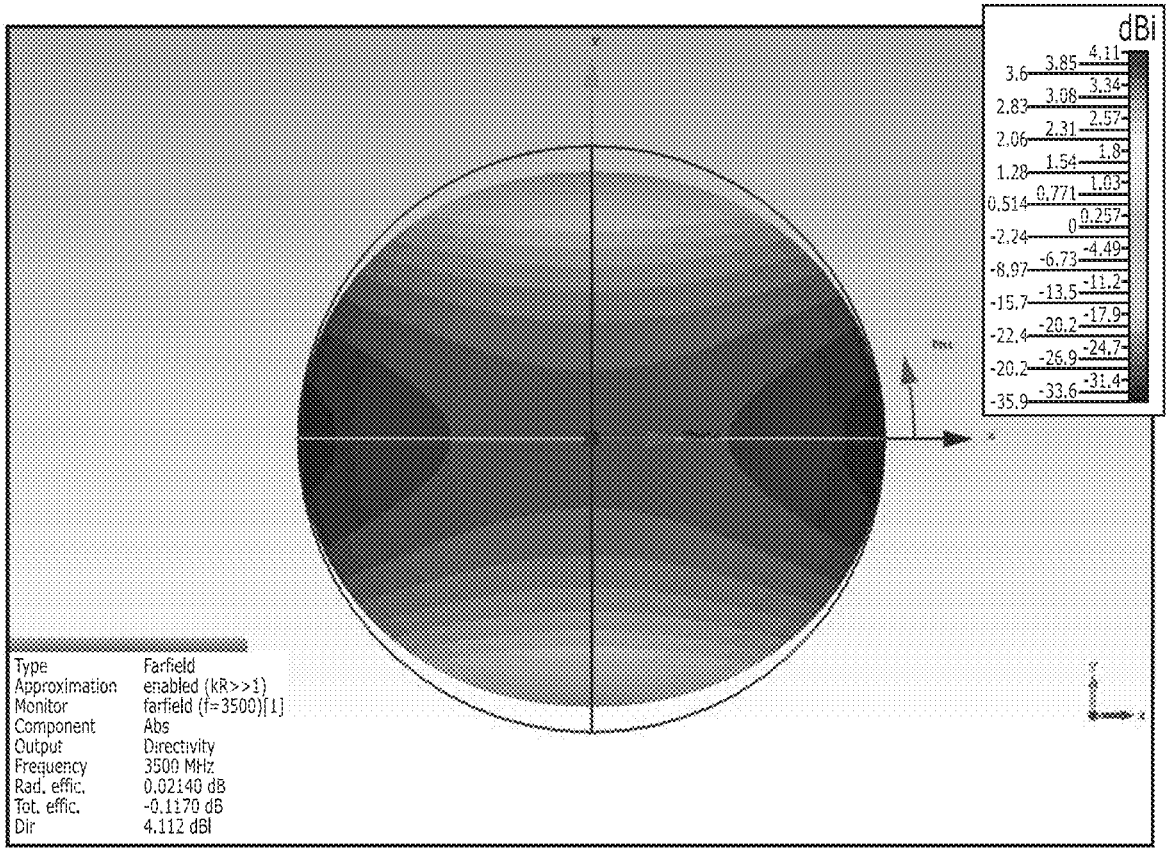
Figure 6:
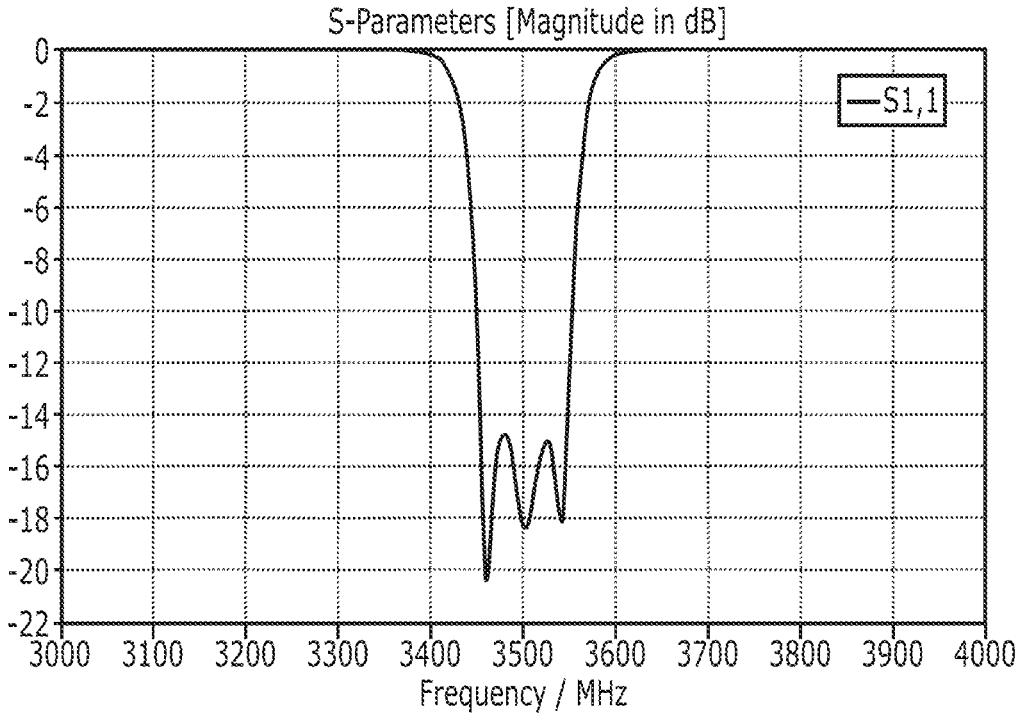
Figure 7:
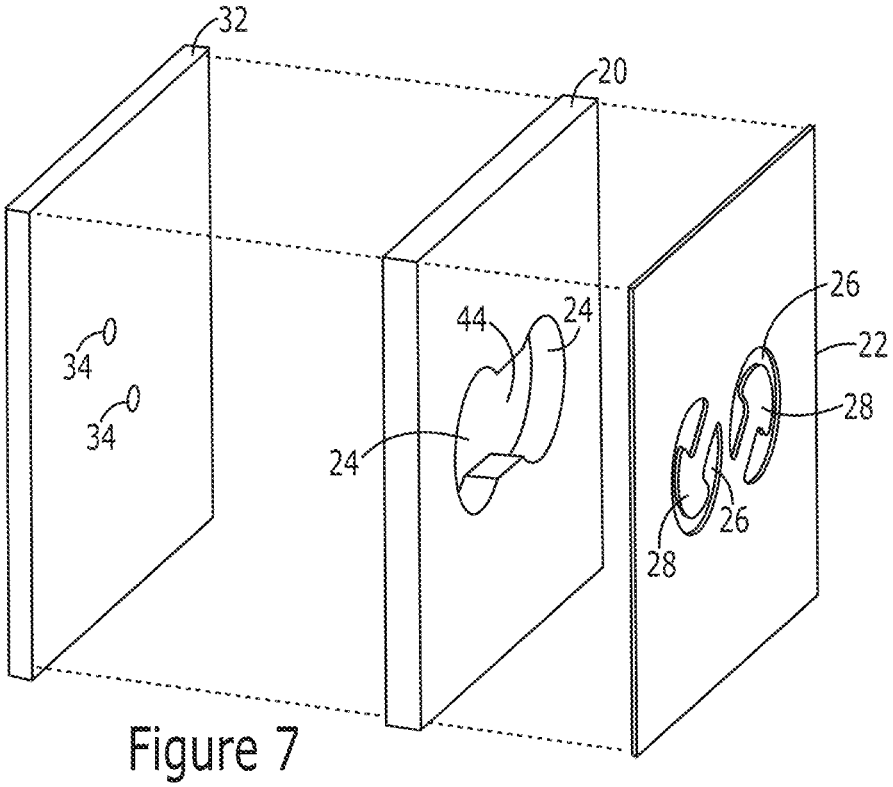
Figure 8A:
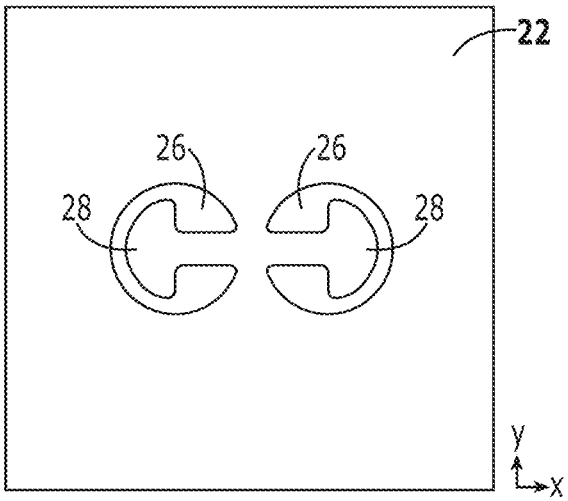
Figure 8B:
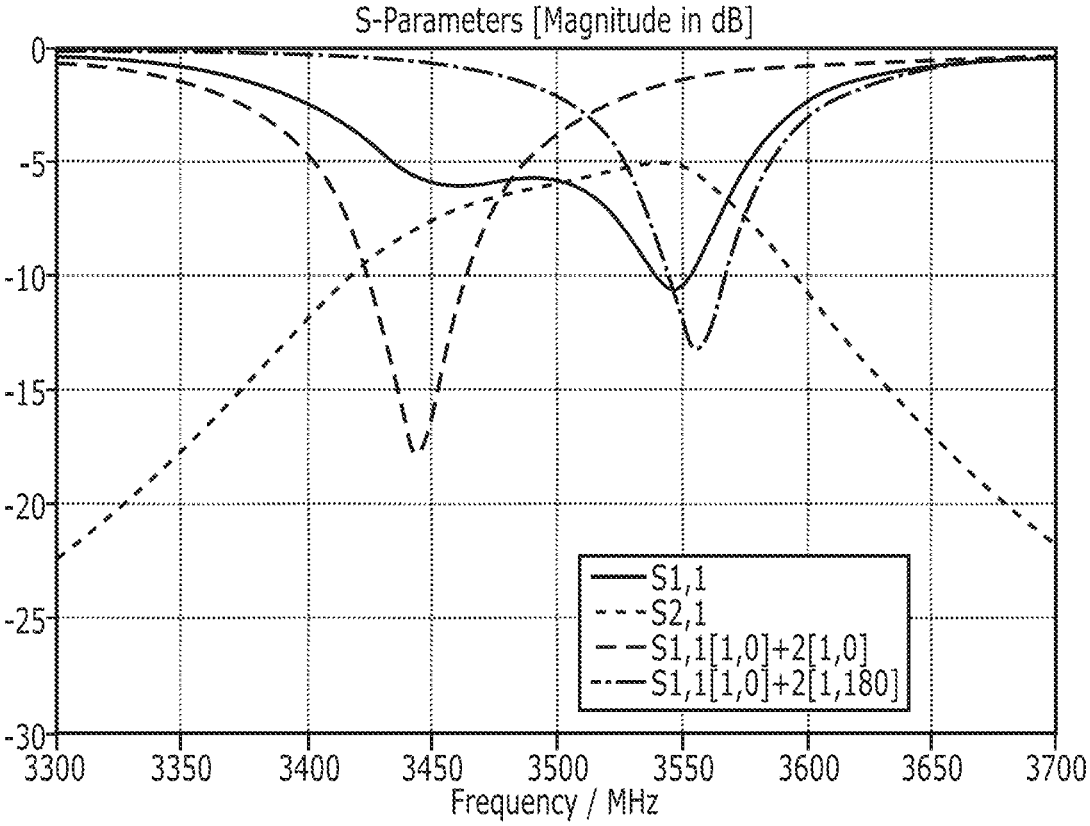

Having thus described certain example embodiments of the present disclosure in general terms, reference will hereinafter be made to the accompanying drawings, which are not necessarily drawn to scale, and wherein:

FIG. 1 represents a multi-filtenna system in accordance with an example embodiment of the present disclosure;

FIG. 2 is an exploded view of a filtenna in accordance with an example embodiment of the present disclosure;

FIG. 3 is a perspective view of a feed pin interacting with a resonator section of a filtenna and making contact with the resonant element of the resonator in accordance with an example embodiment of the present disclosure;

FIG. 4 is a graphical representation illustrating coupling between the resonator sections of a filtenna in accordance with an example embodiment of the present disclosure;

FIG. 5 is a far field radiation pattern diagram of a filtenna in accordance with an example embodiment of the present disclosure;

FIG. 6 is a graphical representation of the return loss of a three-pole filtenna in accordance with an example embodiment of the present disclosure;

FIG. 7 is an exploded perspective view of a base and first resonator sections of a multi-filtenna system having a pair of filtennas in accordance with an example embodiment of the present disclosure;

FIG. 8*a* is resonator in accordance with an example embodiment of the present disclosure;

FIG. 8*b* is a graphical representation of the S-parameters of the resonator of FIG. 8*a;*

Figure 9A:
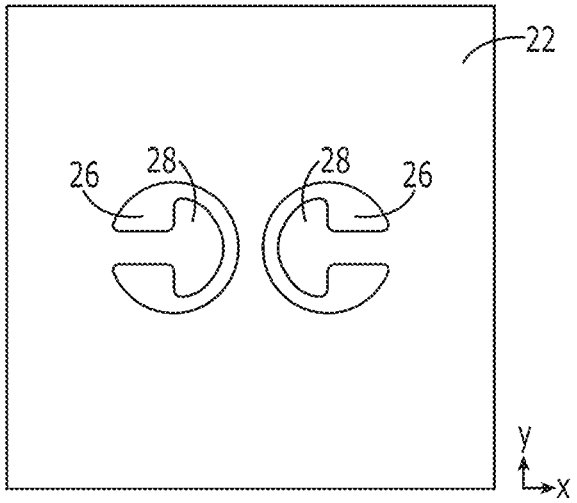
Figure 9B:
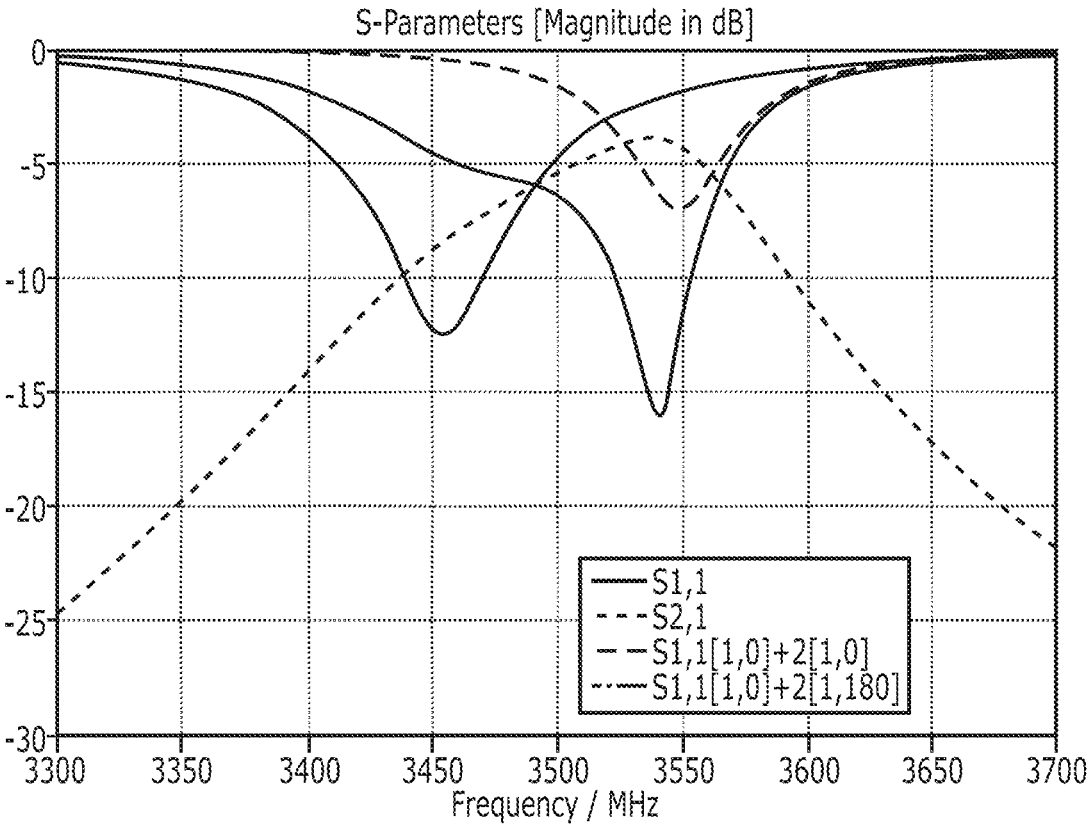

FIG. 9*a* is resonator in accordance with another example embodiment of the present disclosure;

FIG. 9*b* is a graphical representation of the S-parameters of the resonator of FIG. 9*a;*

Figure 10A:
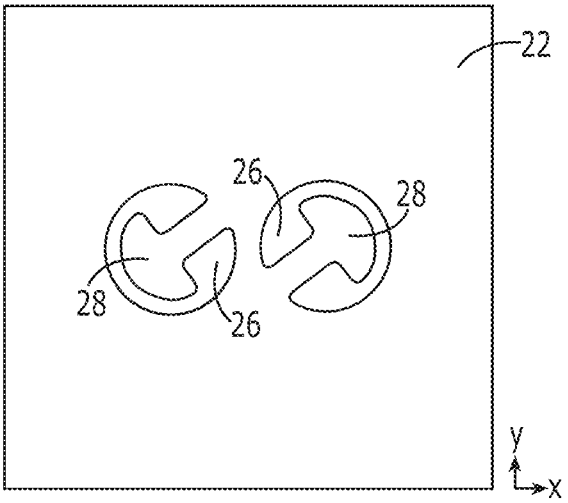
Figure 10B:
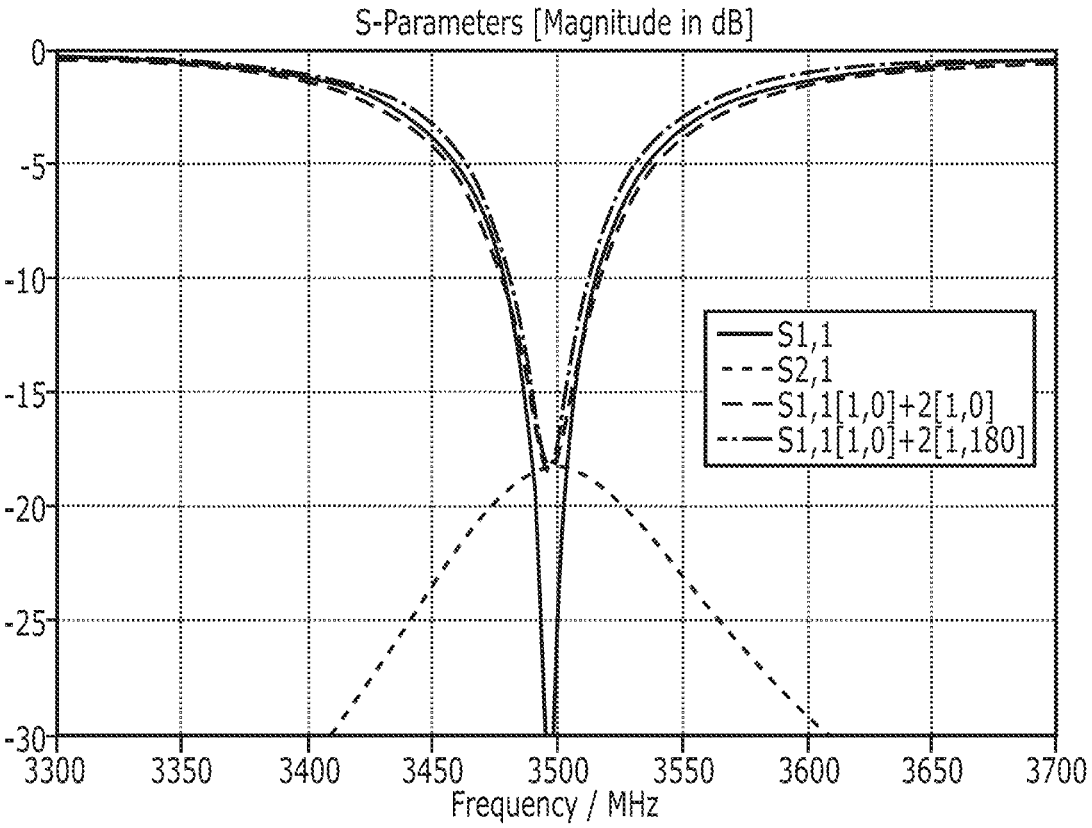

FIG. 10*a* is resonator in accordance with a further example embodiment of the present disclosure;

FIG. 10*b* is a graphical representation of the S-parameters of the resonator of FIG. 10*a;*

Figure 11A:
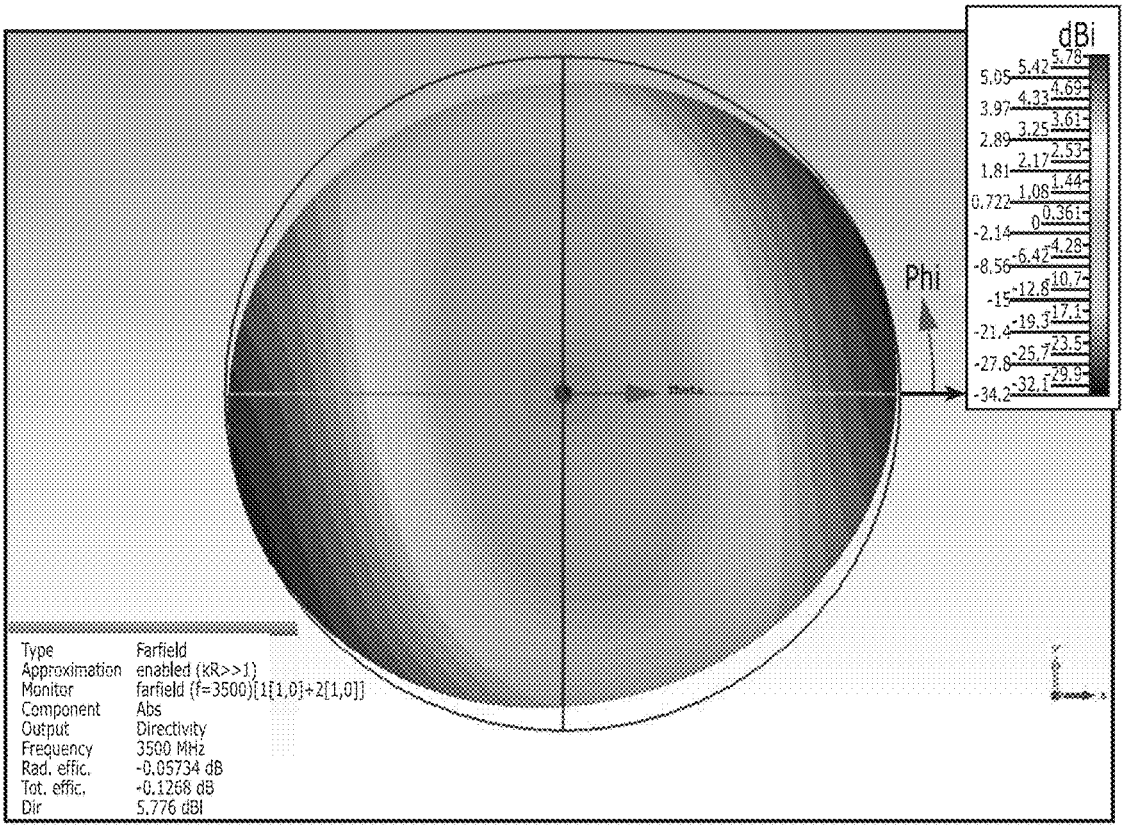
Figure 11B:
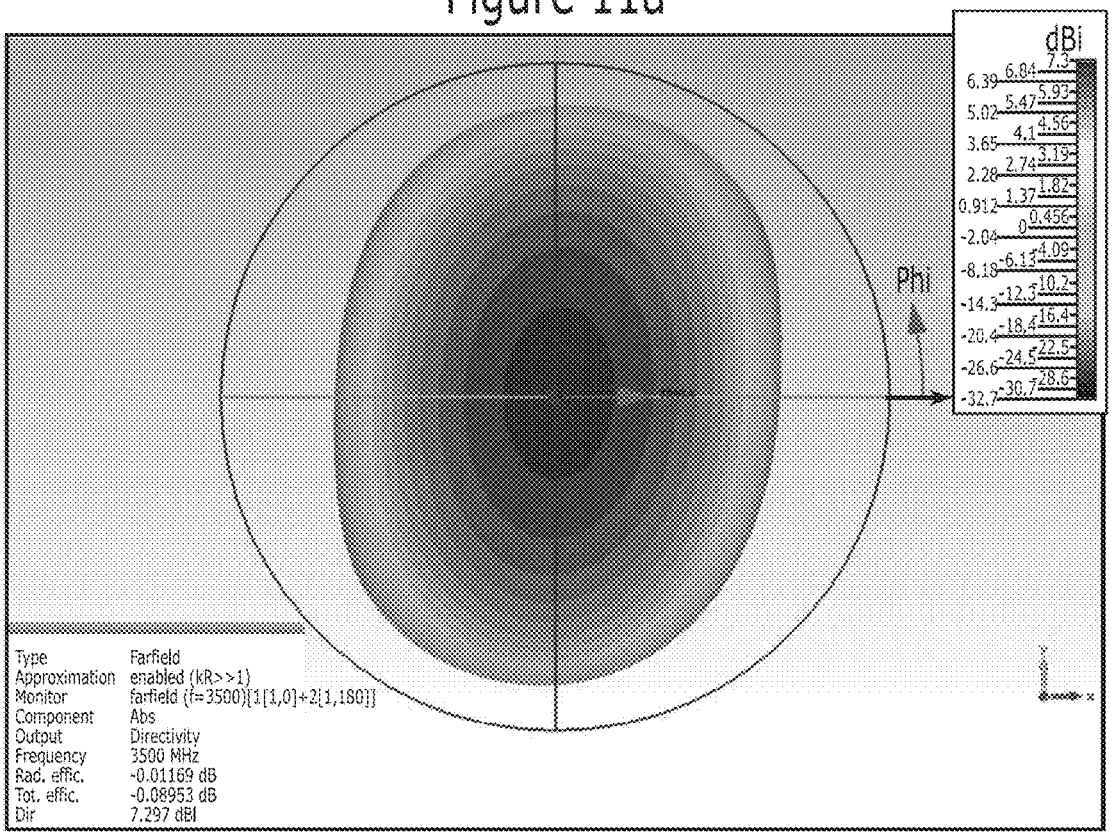
Figure 12:
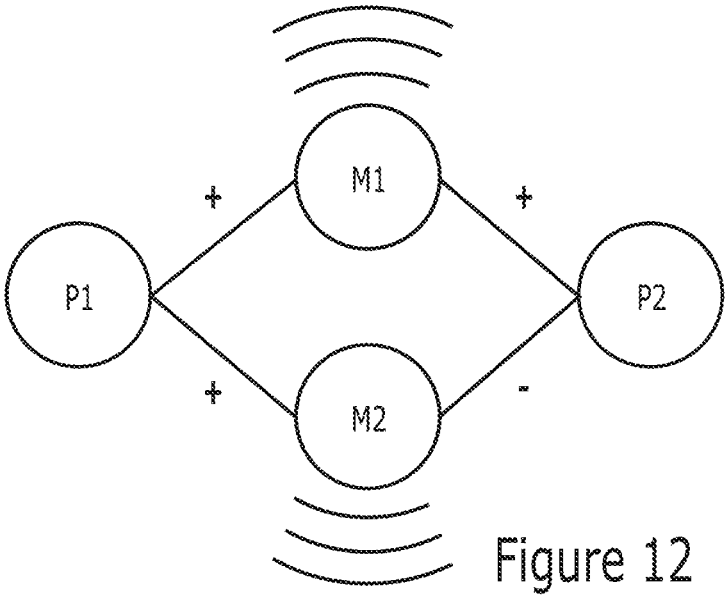
Figure 13:
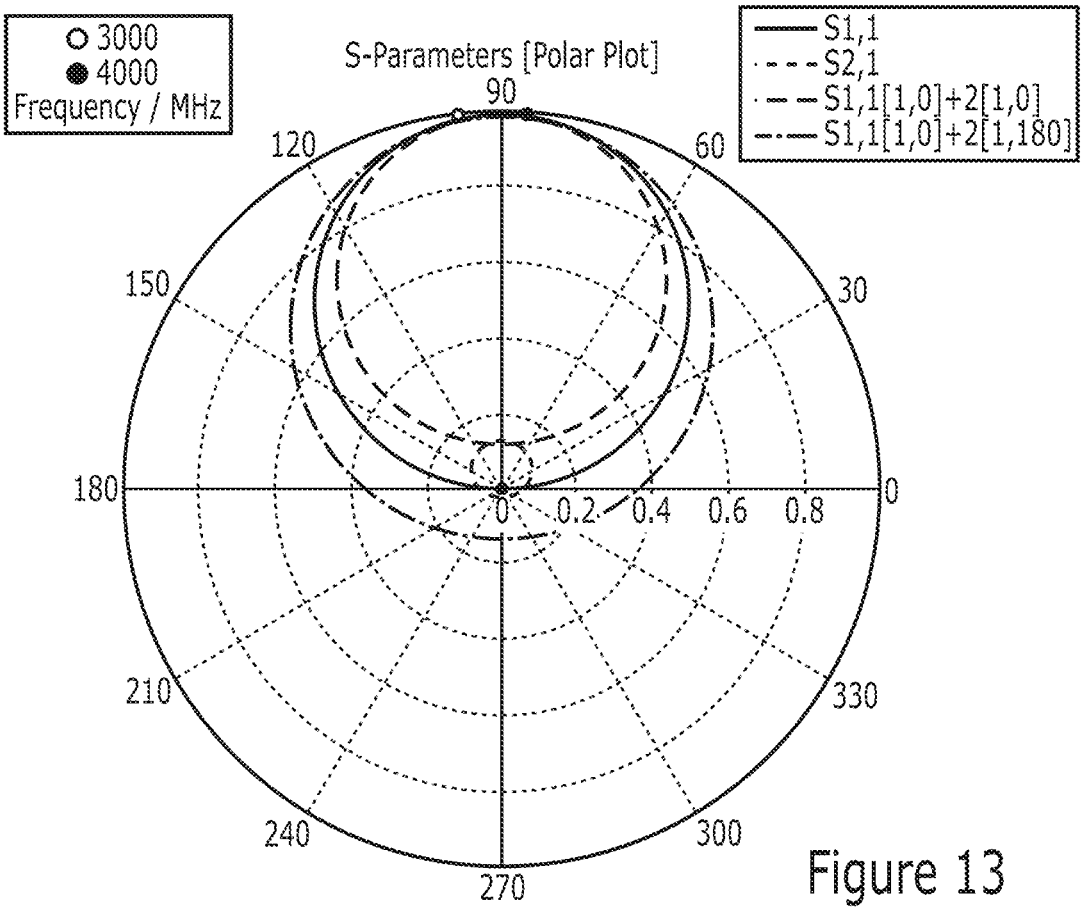

FIGS. 11*a* and 11*b* are far field radiation pattern diagrams produced by a pair of quarter wave resonators when driven in phase and out of phase, respectively, in accordance with an example embodiment of the present disclosure;

FIG. 12 is a graphical representation illustrating coupling between a pair of radiating resonators of a multi-filtenna system in accordance with an example embodiment of the present disclosure;

FIG. 13 is a polar plot of the response of the pair of radiating resonators of FIG. 10*a;*

Figure 14A:
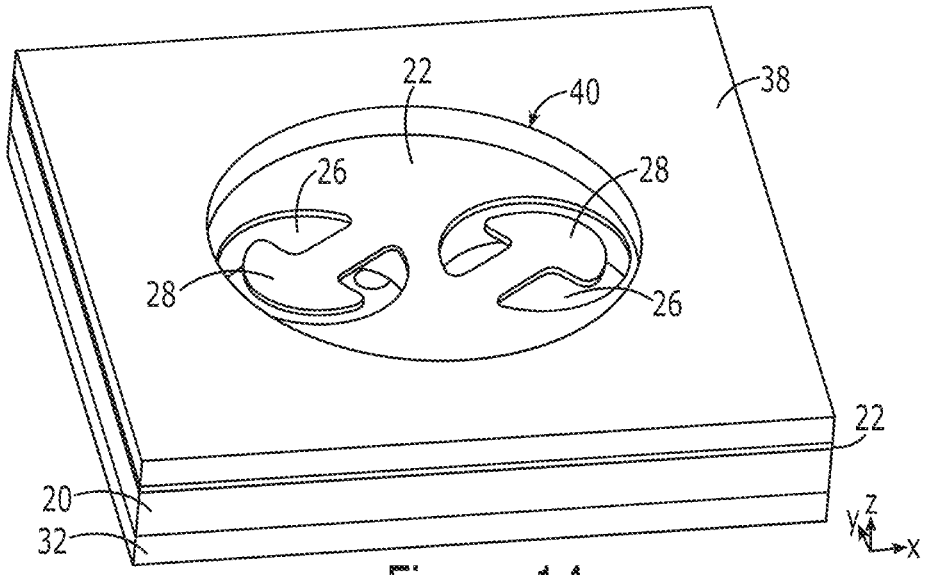
Figure 14B:
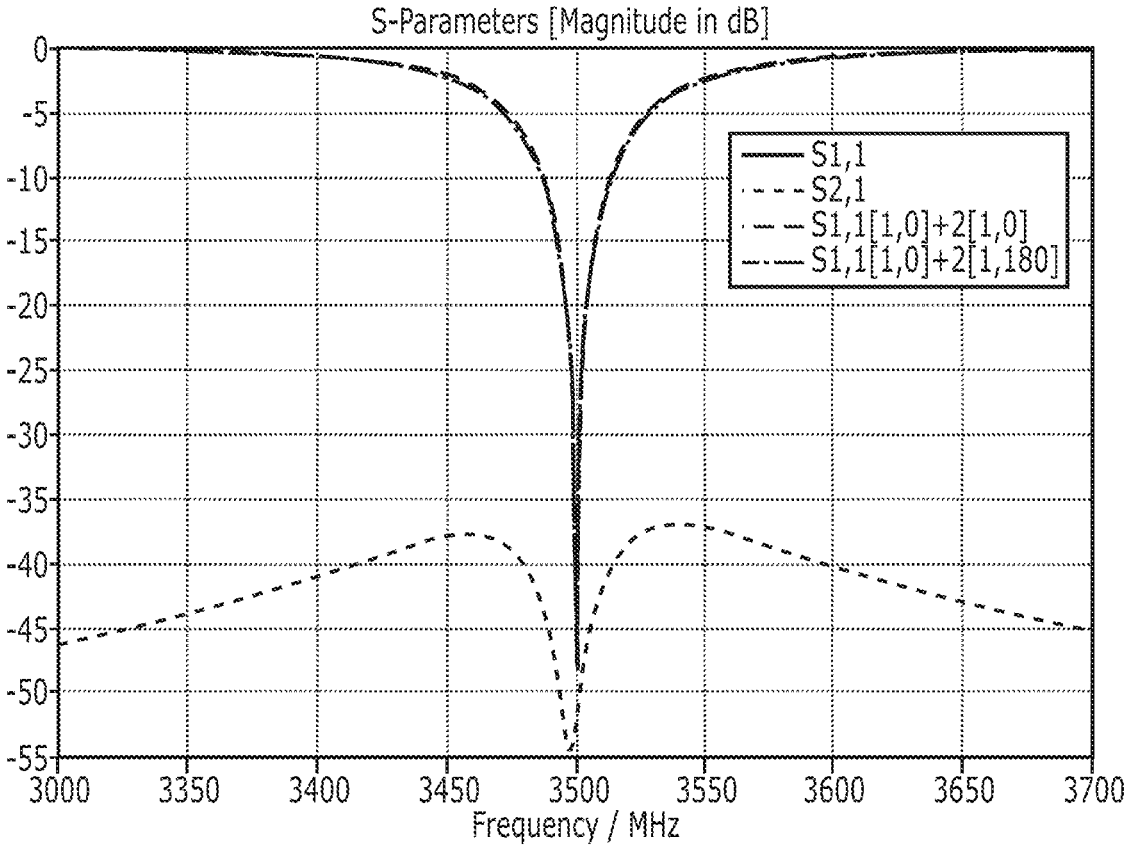

FIG. 14*a* is a perspective view of the resonators of a pair of filtennas and a ground wall element surrounding the resonators in accordance with an example embodiment of the present disclosure;

FIG. 14*b* is a graphical representation of the S-parameters of the resonators and ground wall element of FIG. 14*a;*

Figure 15:
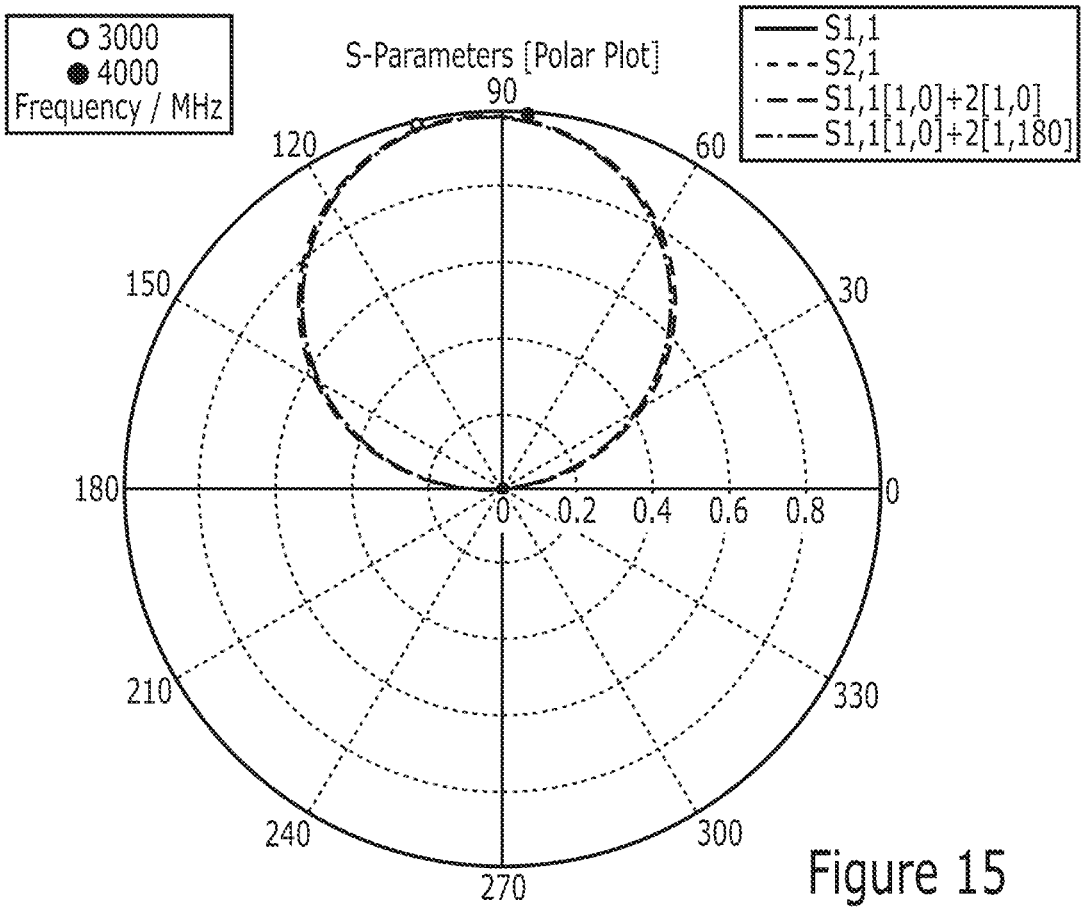

FIG. 15 is a polar plot of the response of the resonators and ground wall element of FIG. 14*a;*

Figure 16A:
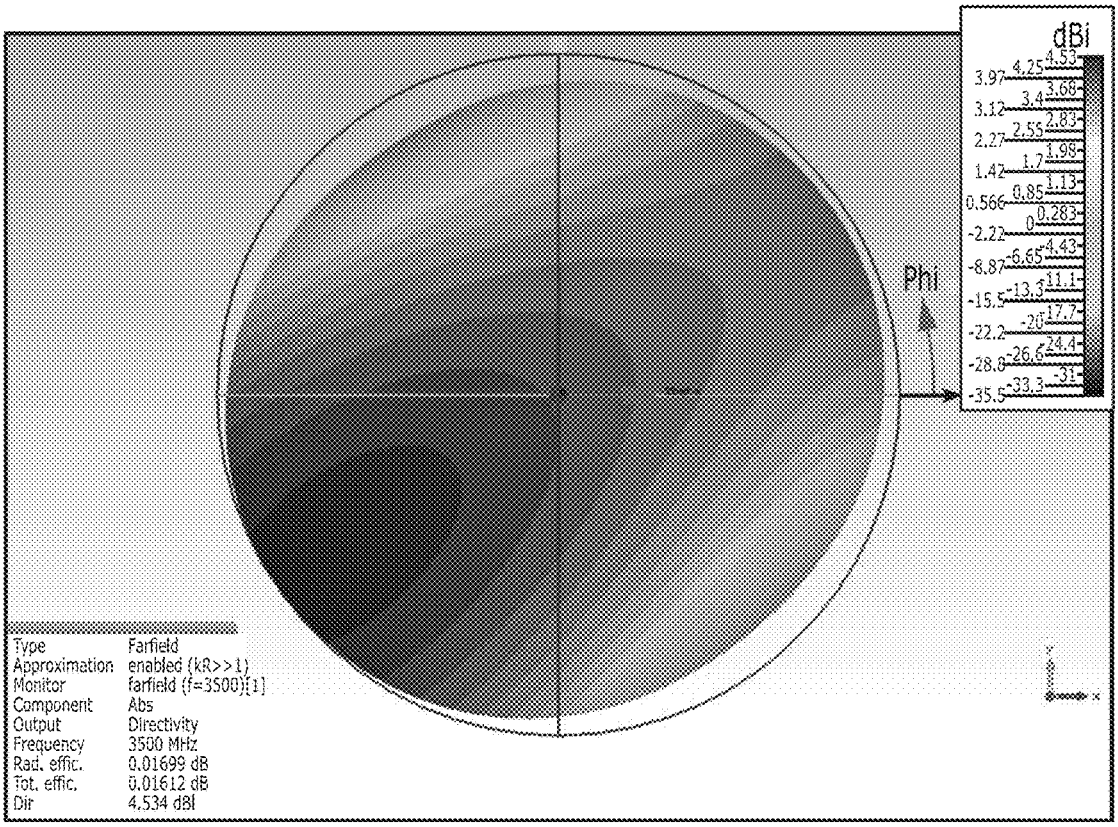
Figure 16B:
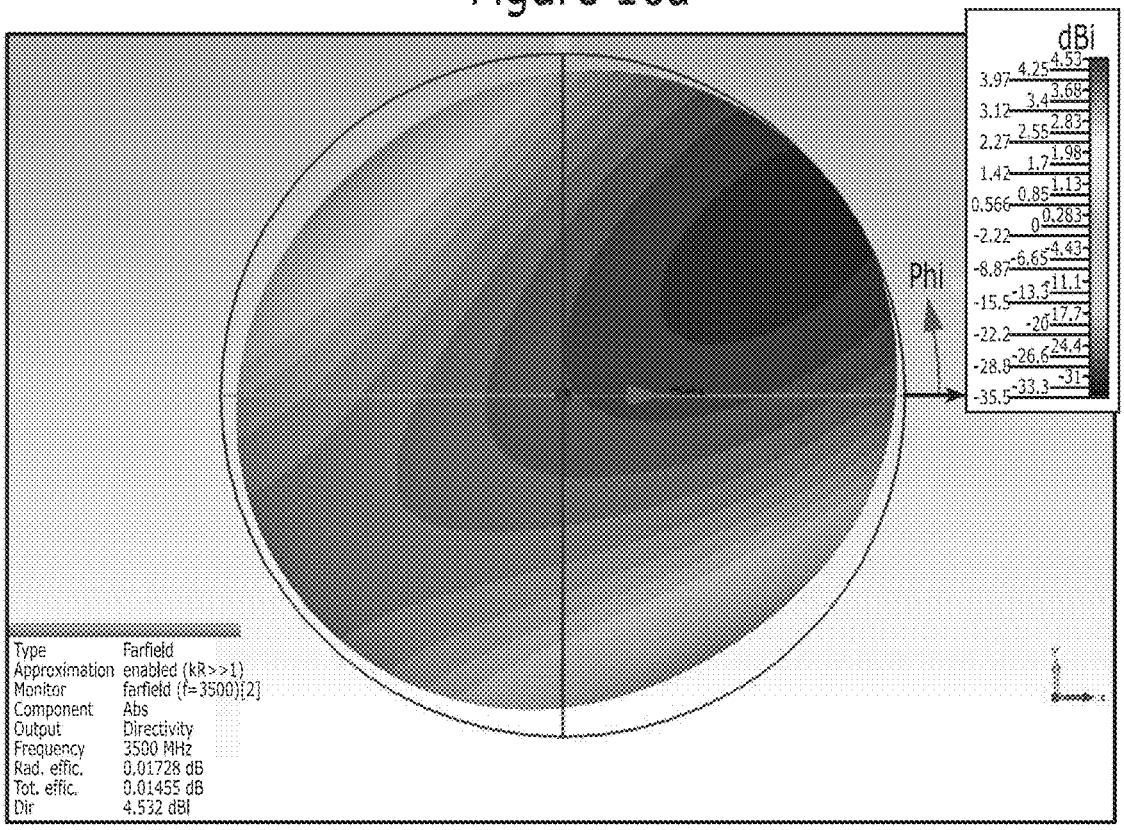
Figure 17A:
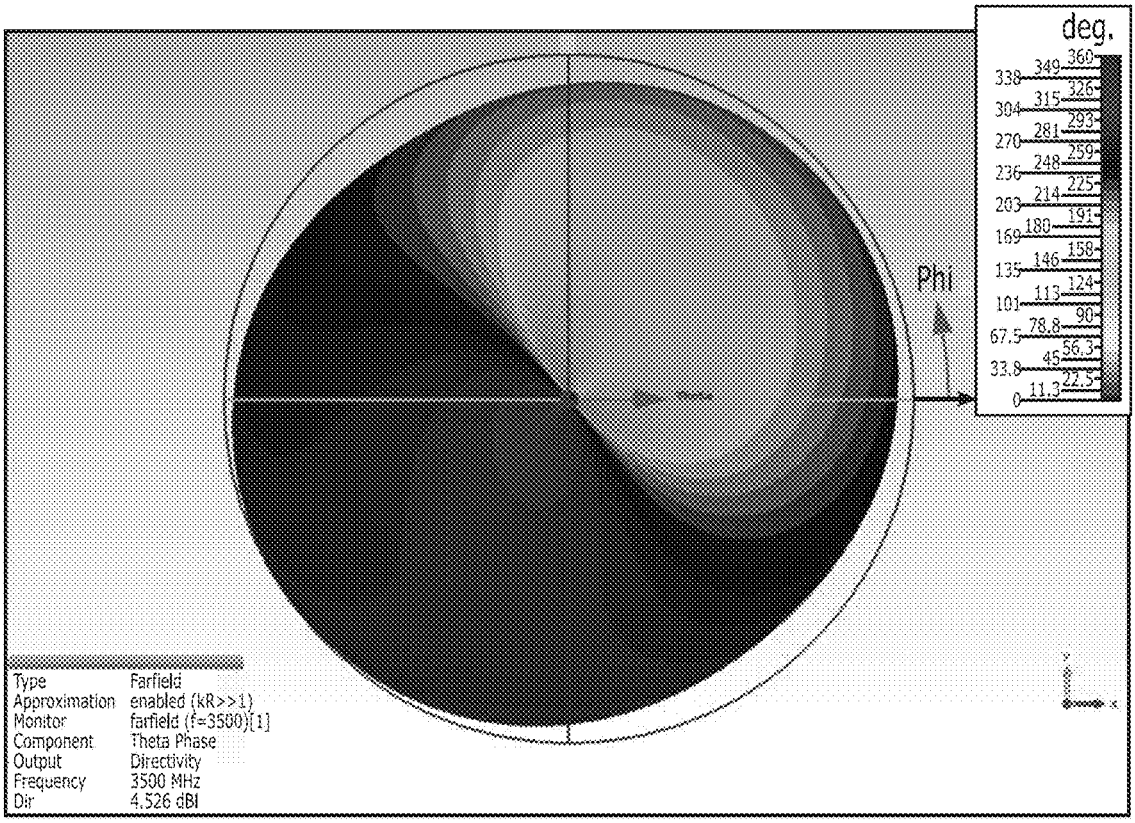
Figure 17B:
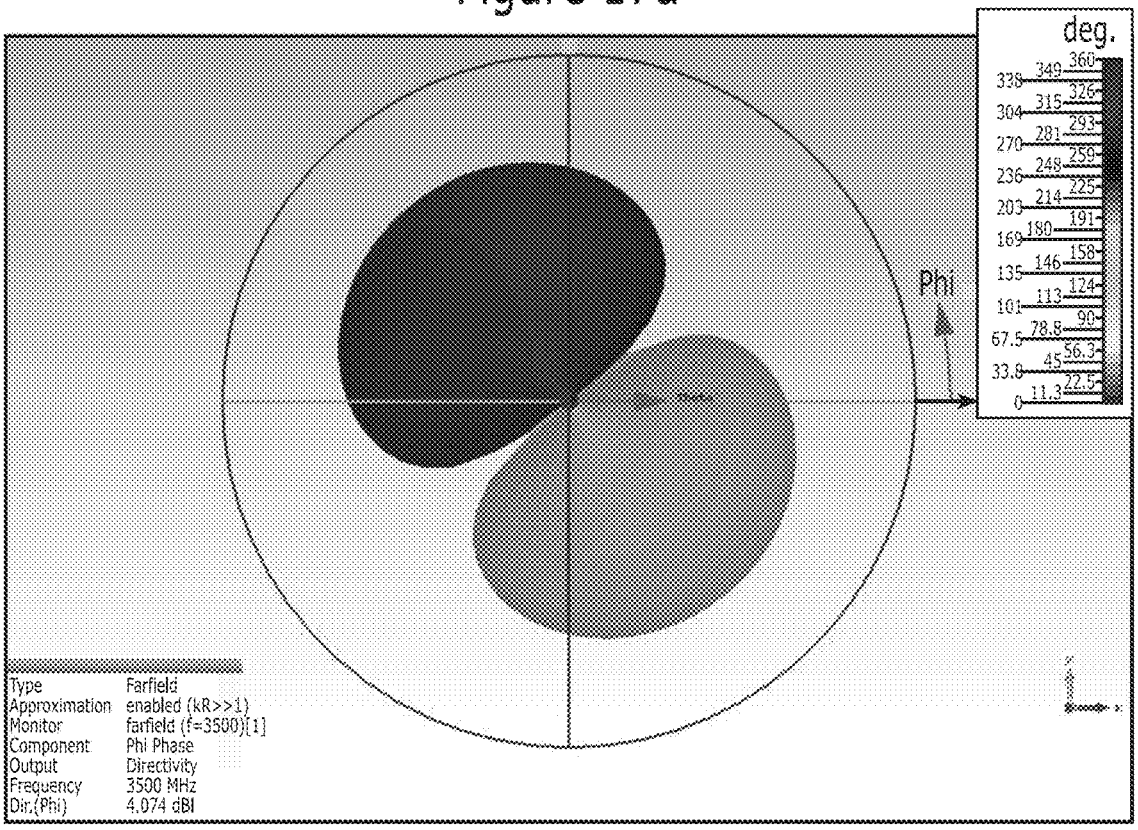
Figure 18A:
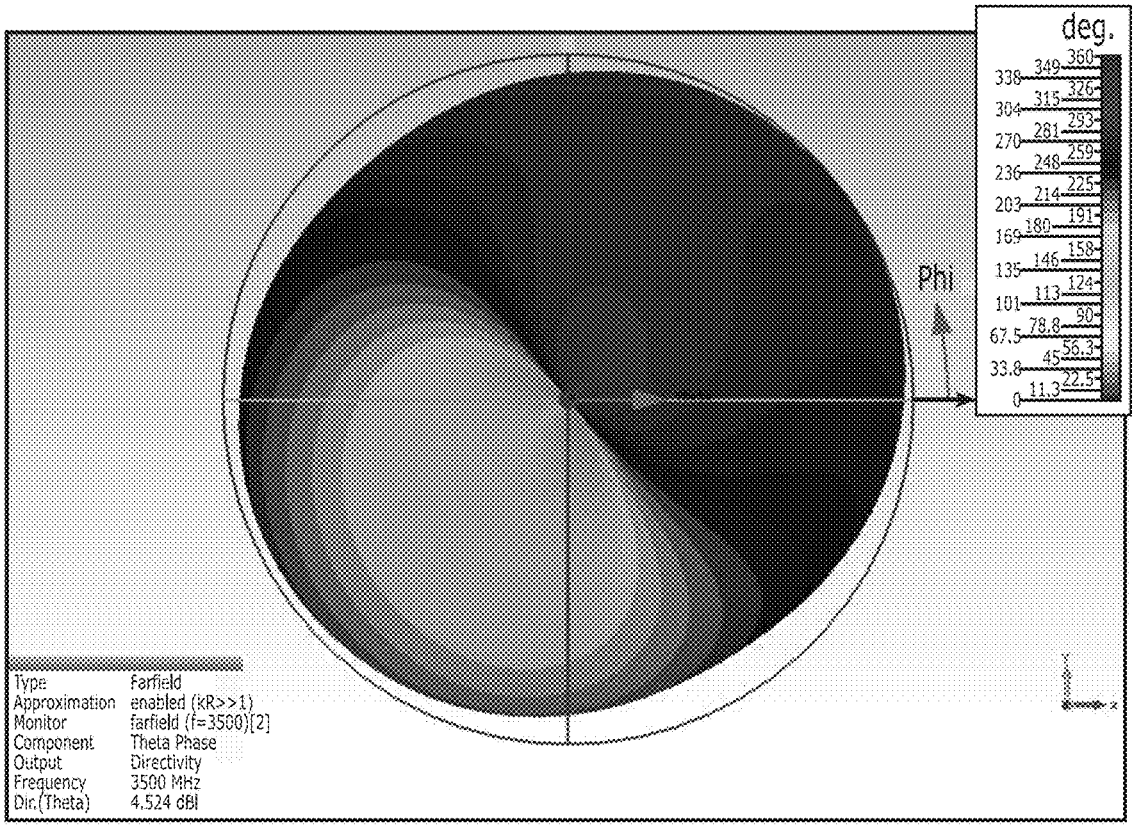
Figure 18B:
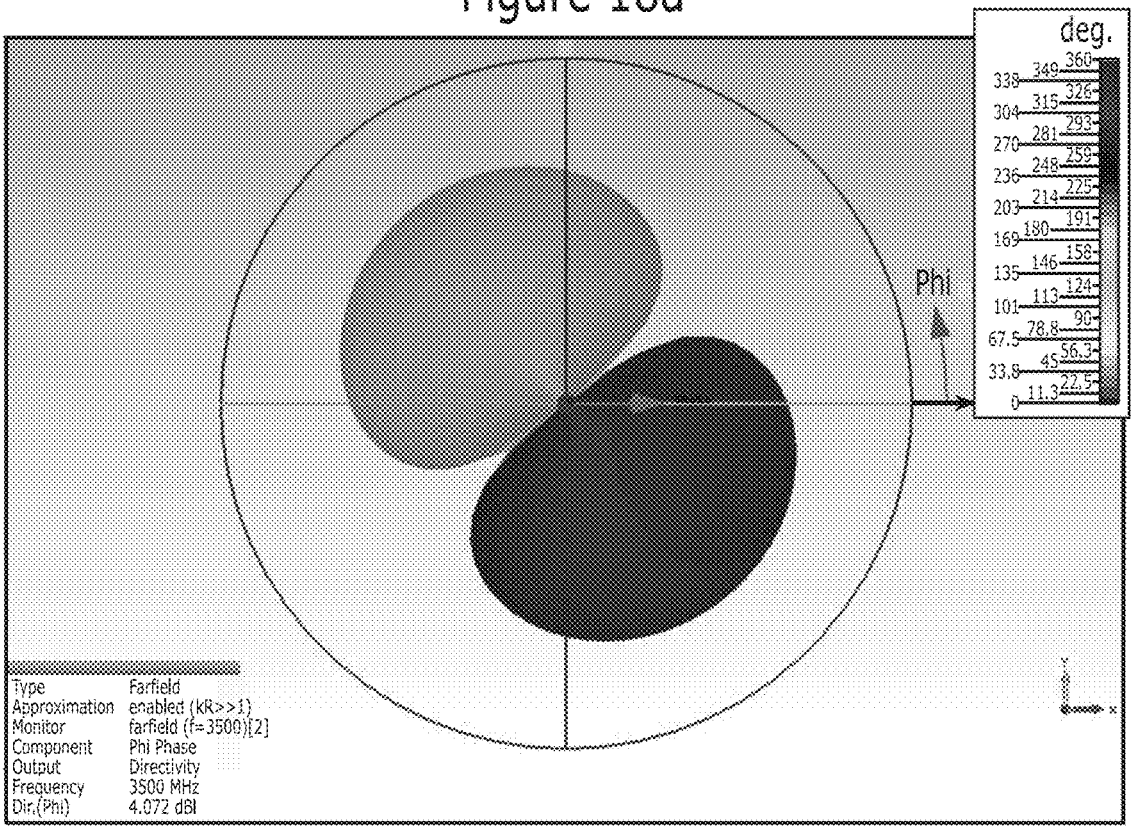
Figure 19A:
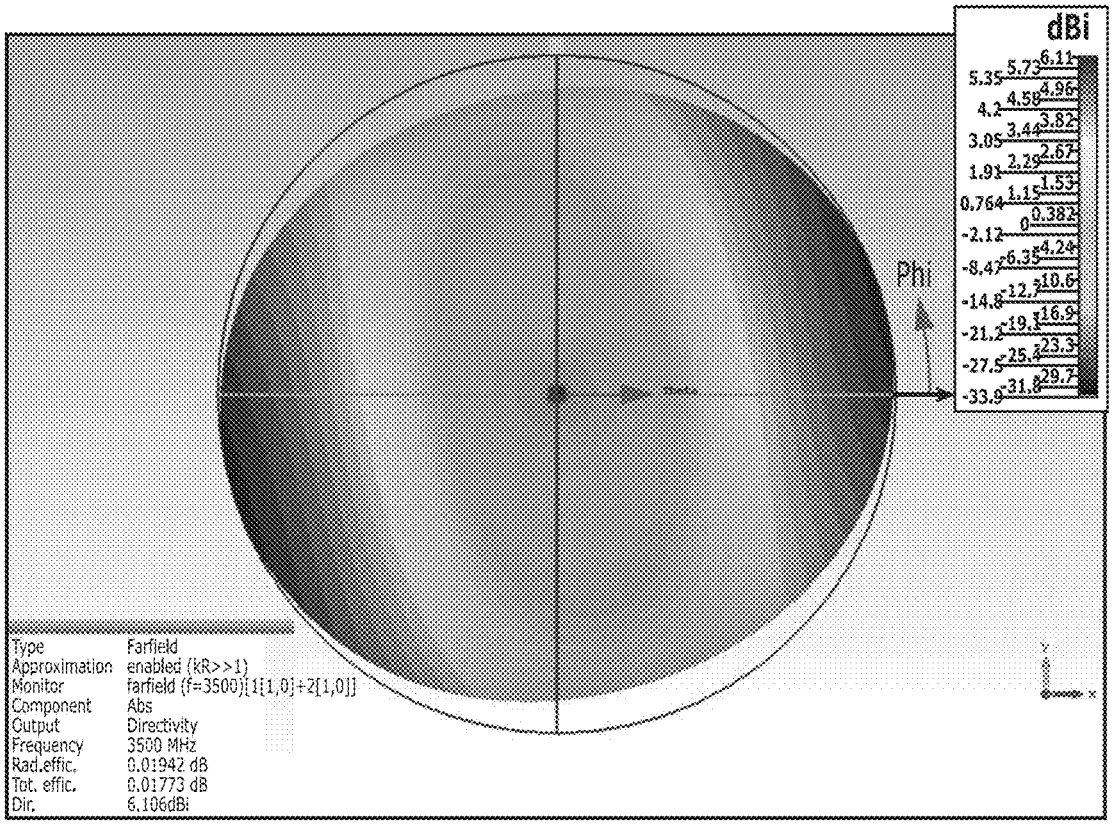
Figure 19B:
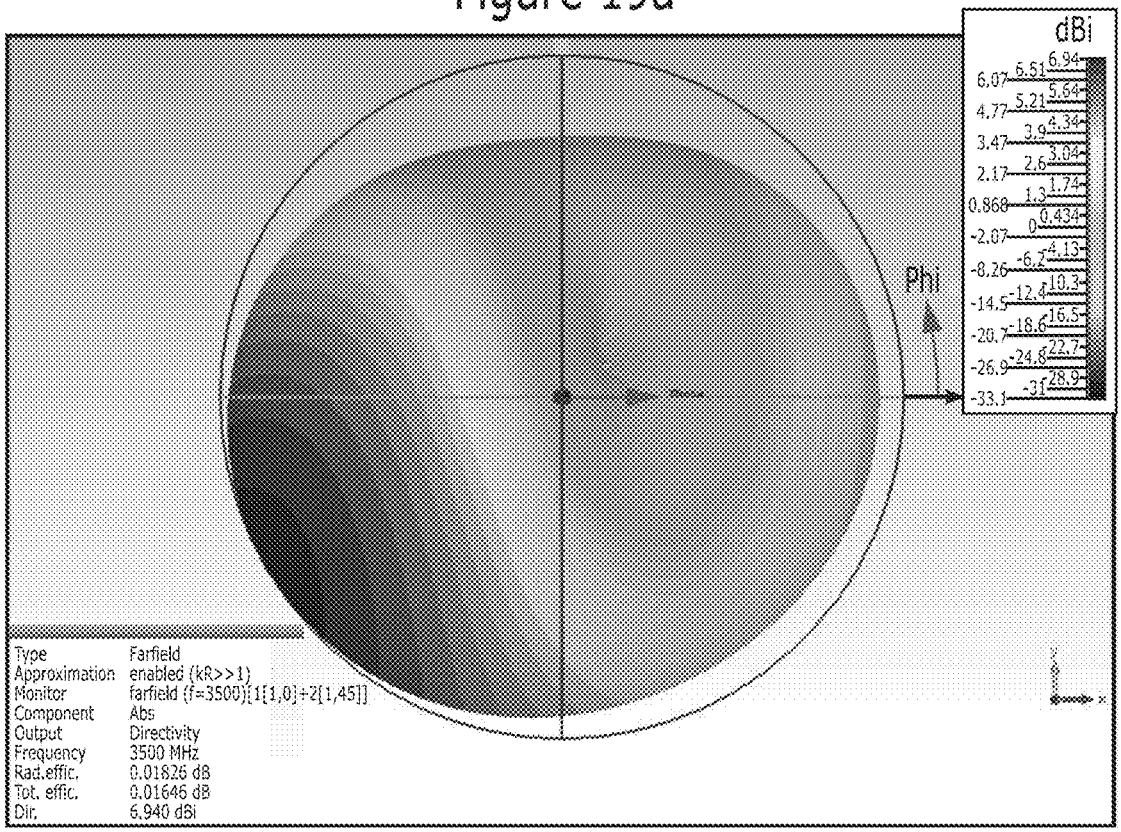
Figure 19C:
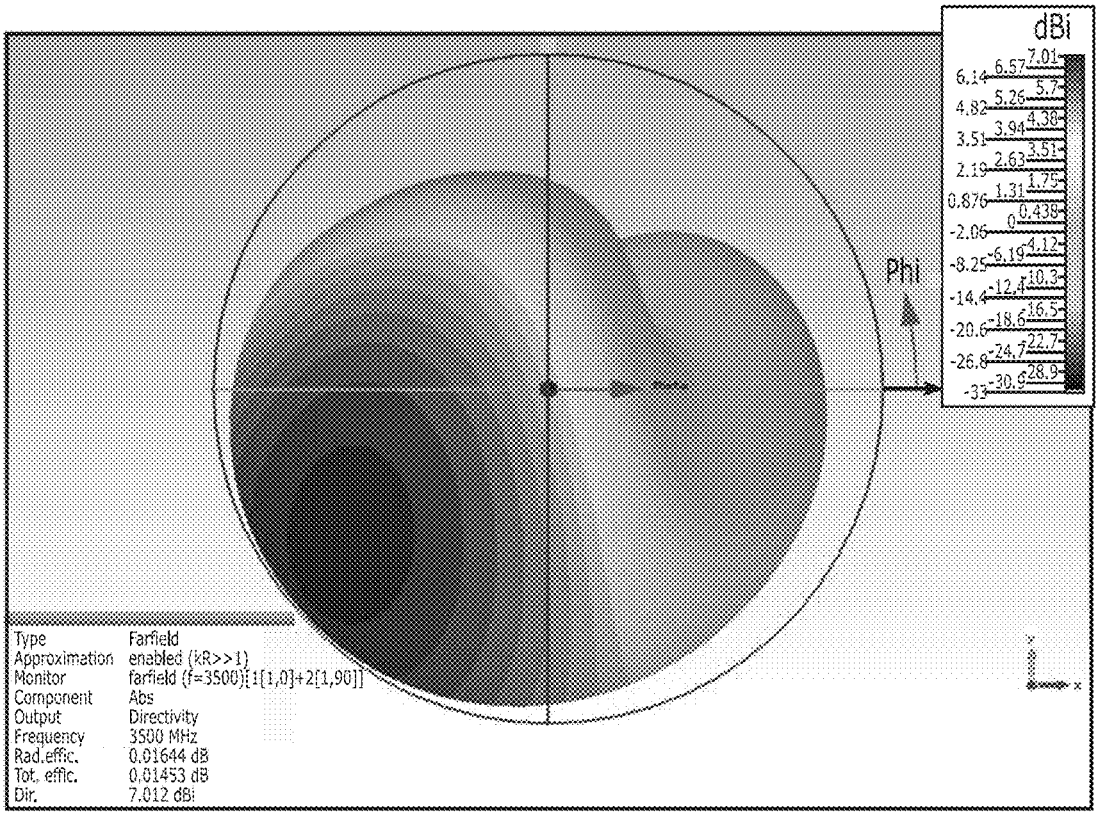
Figure 19D:
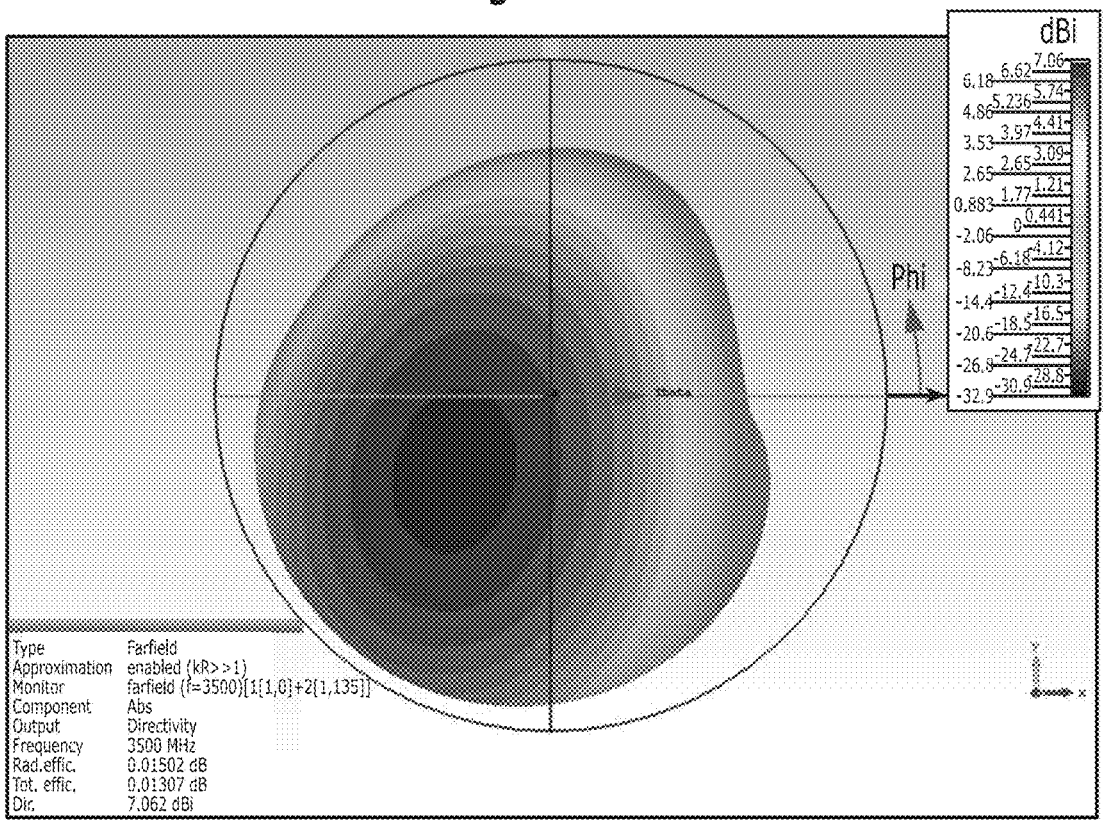
Figure 19E:
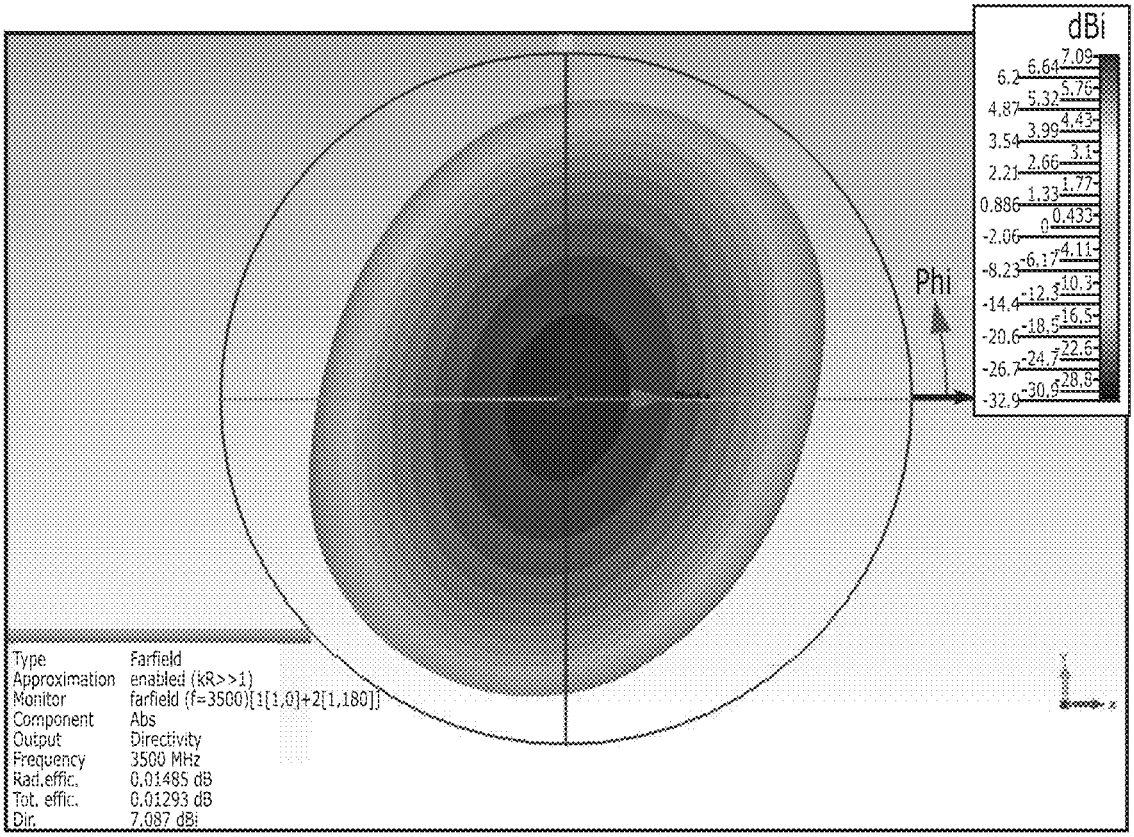
Figure 20:
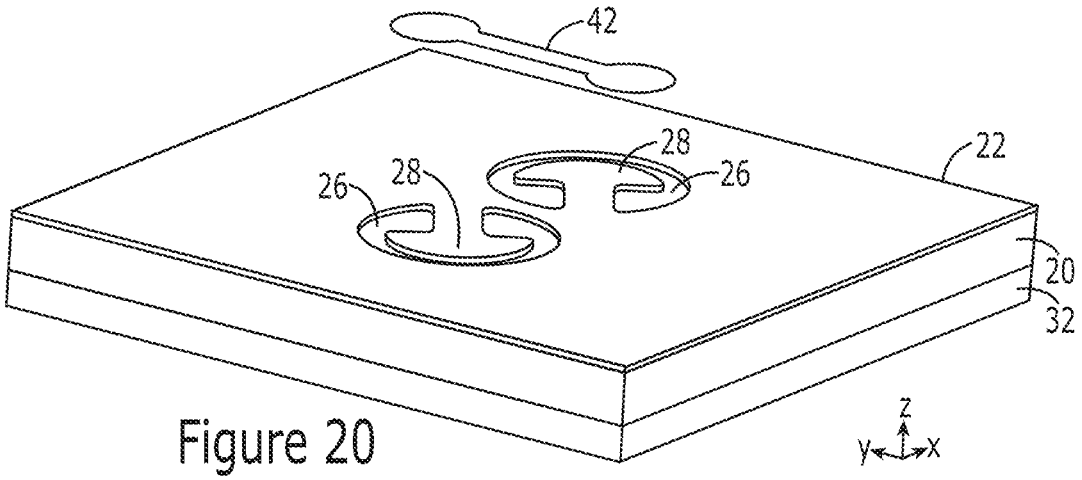
Figure 21:
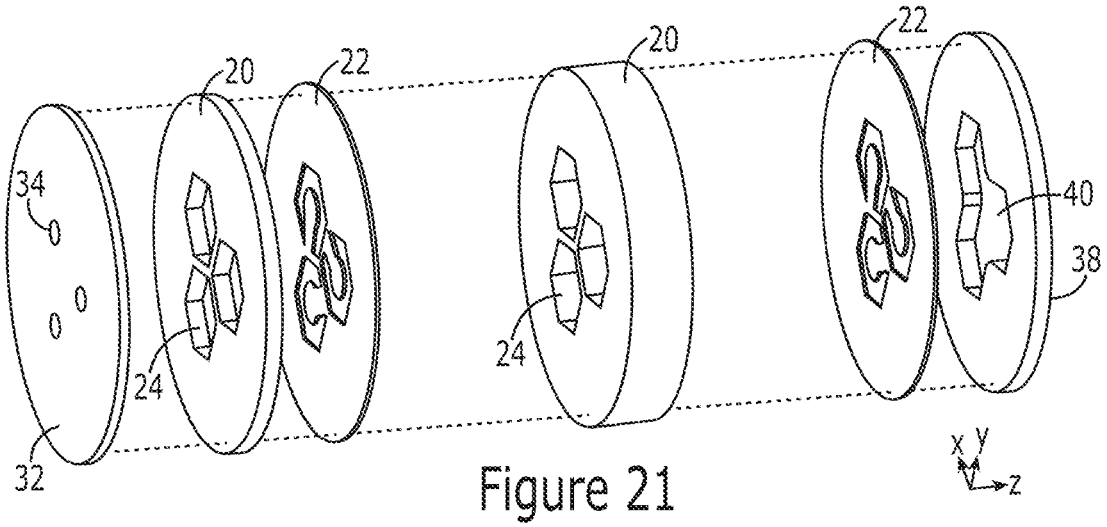
Figure 22:
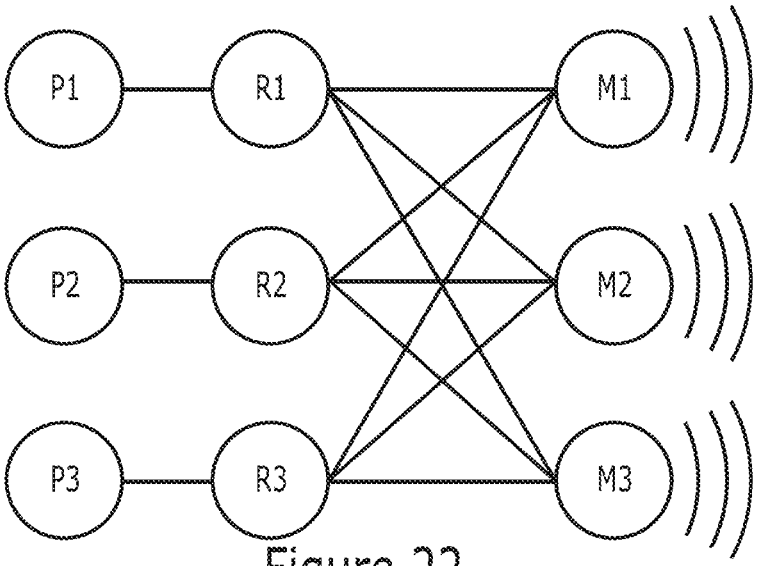
Figure 23A:
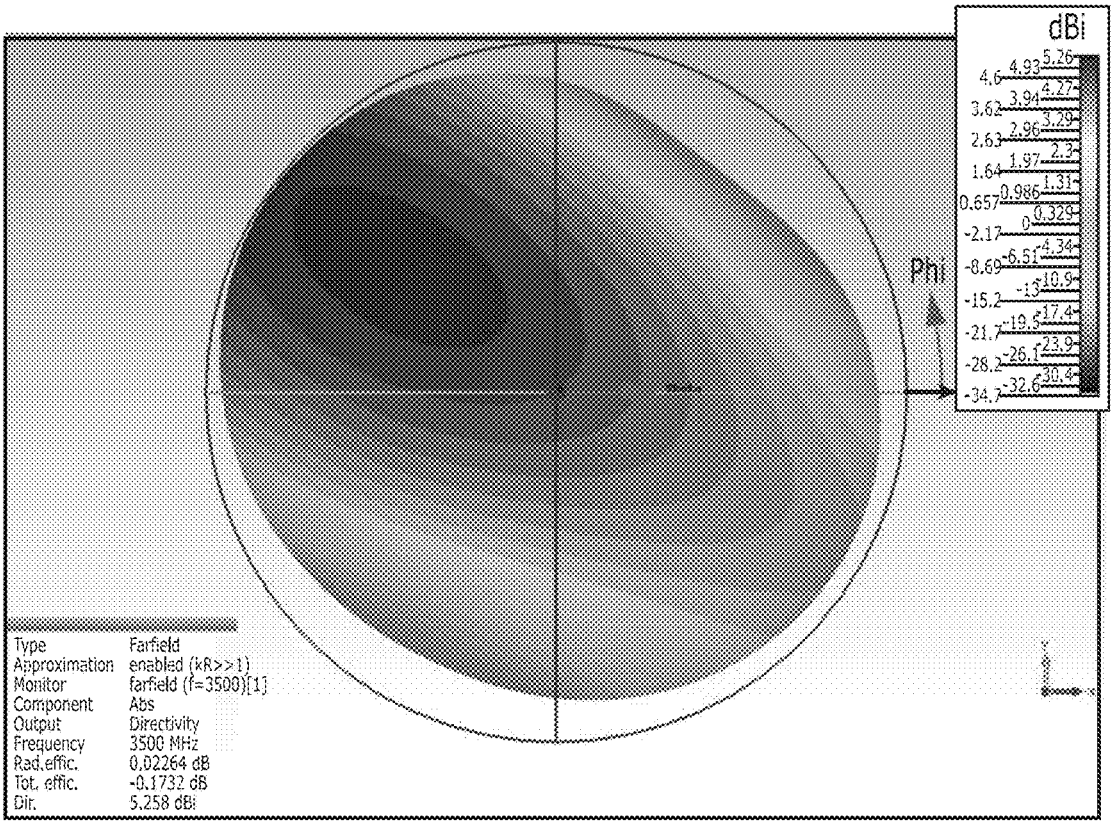
Figure 23B:
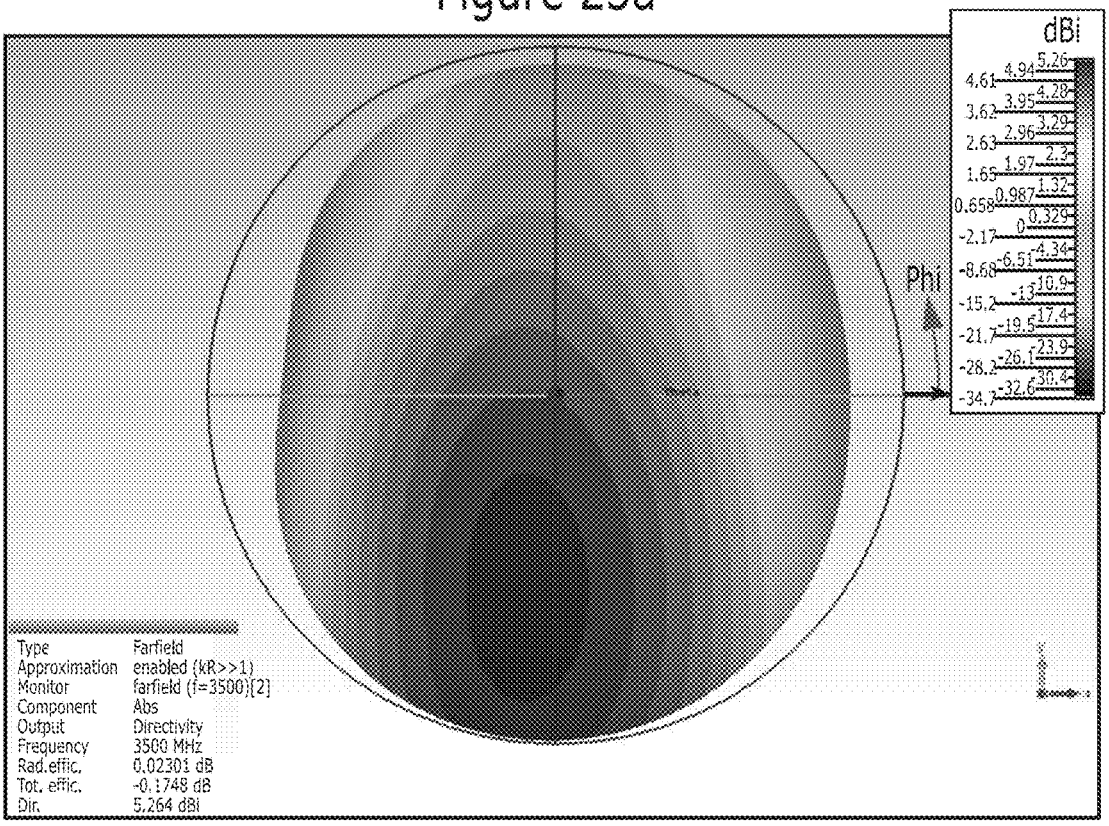
Figure 23C:
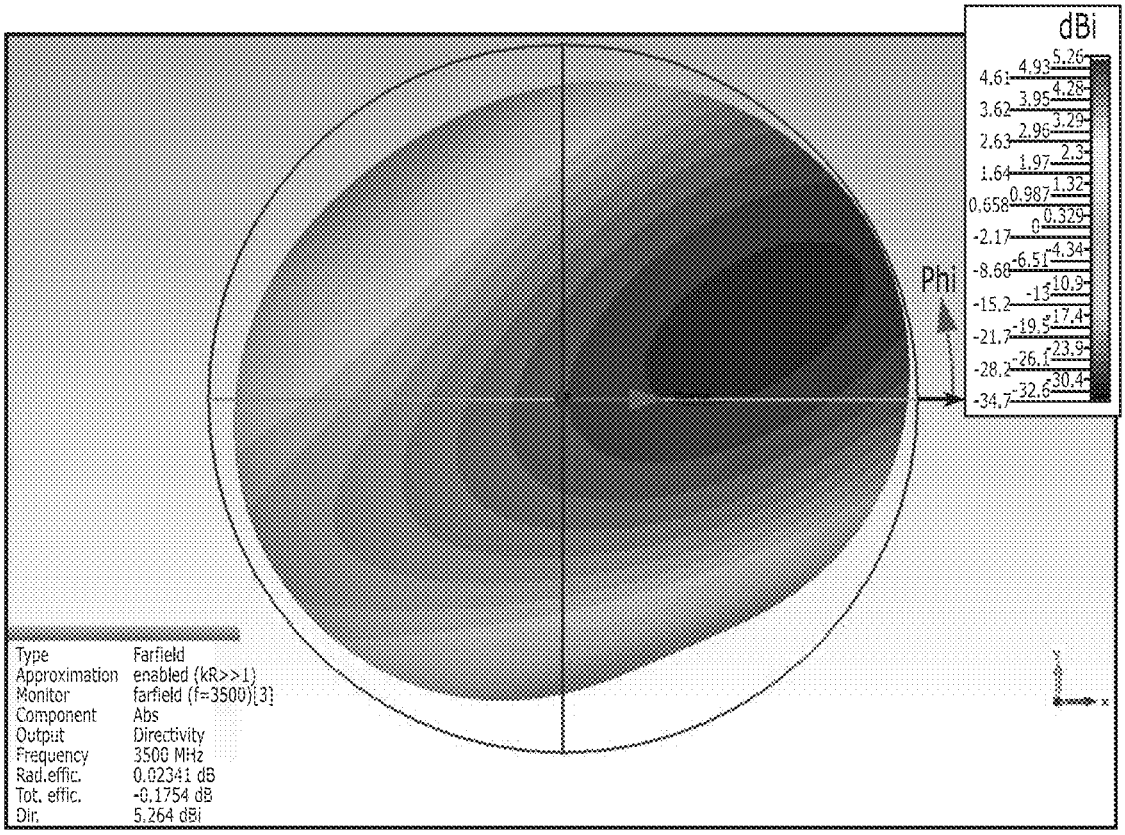
Figure 24A:
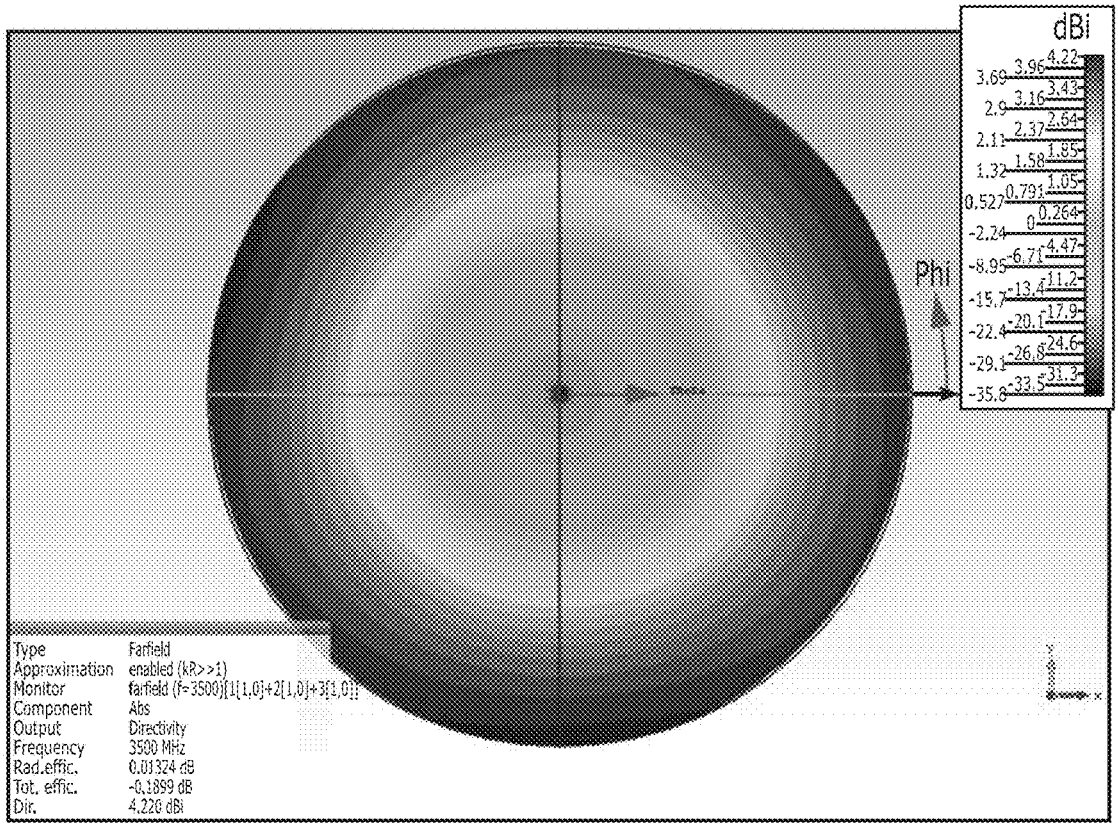
Figure 24B:
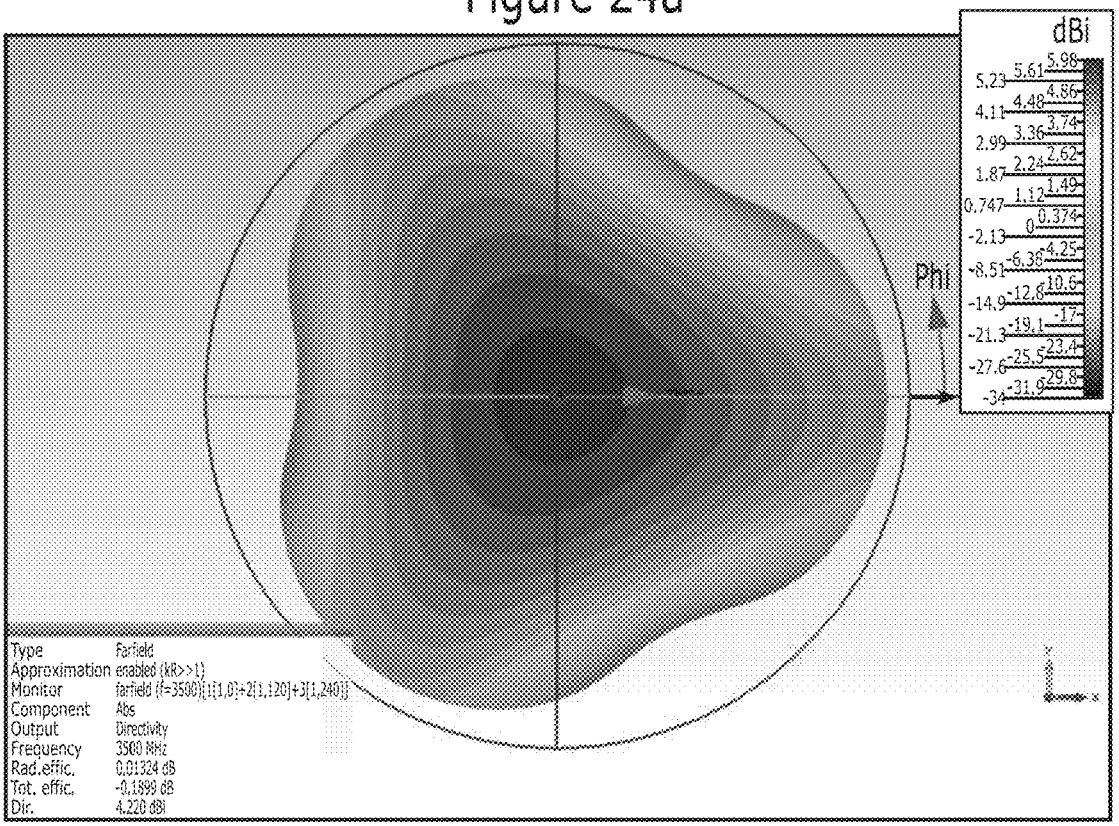
Figure 24C:
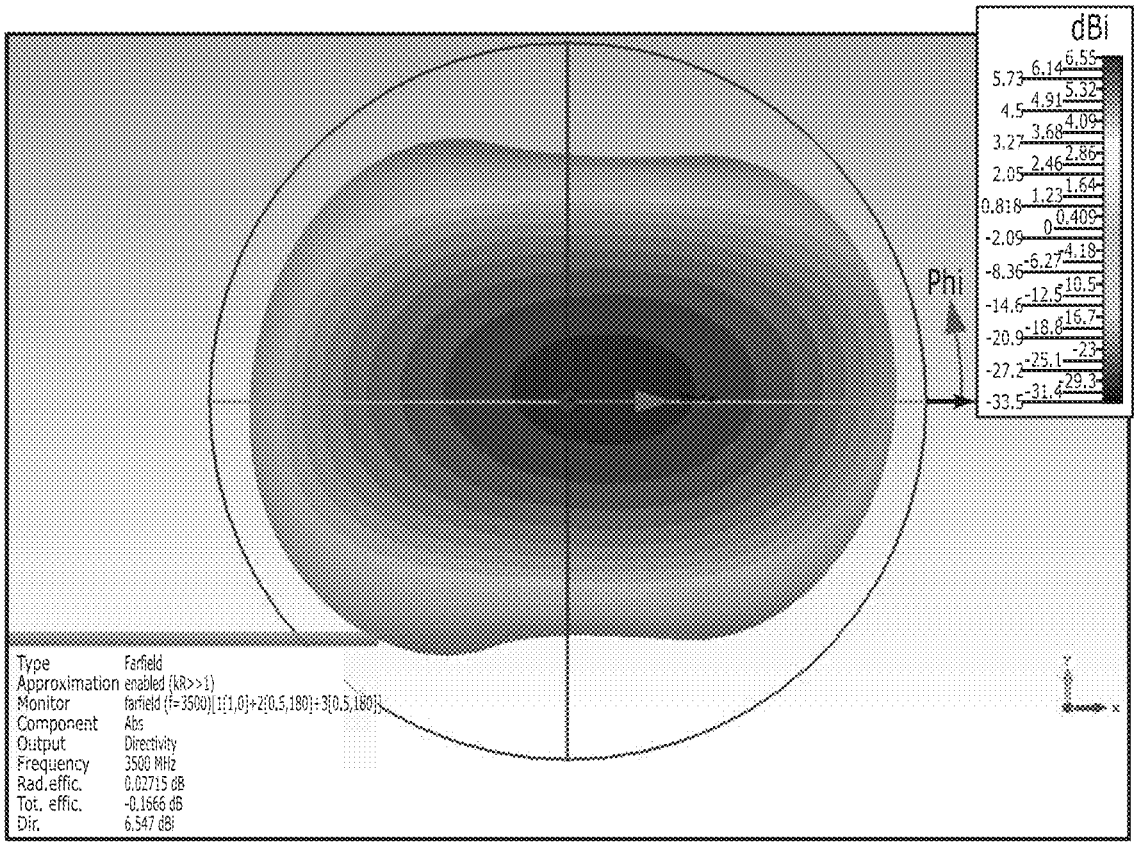
Figure 25:
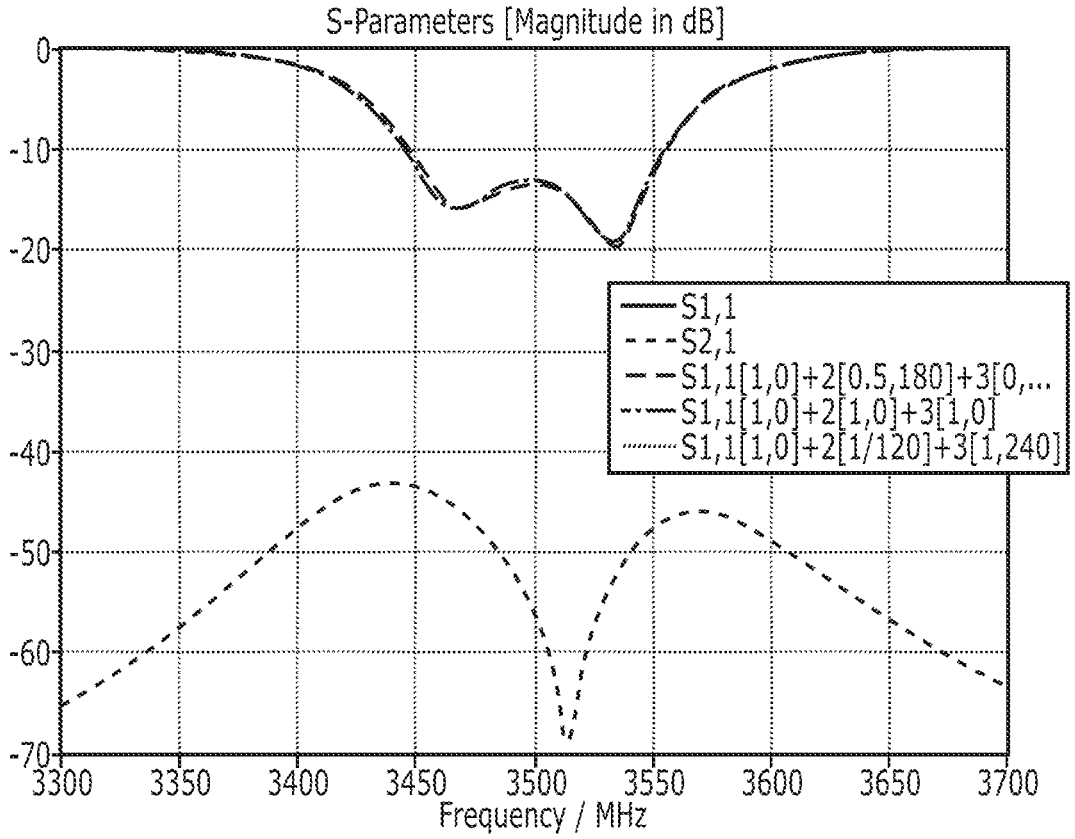
Figure 26:
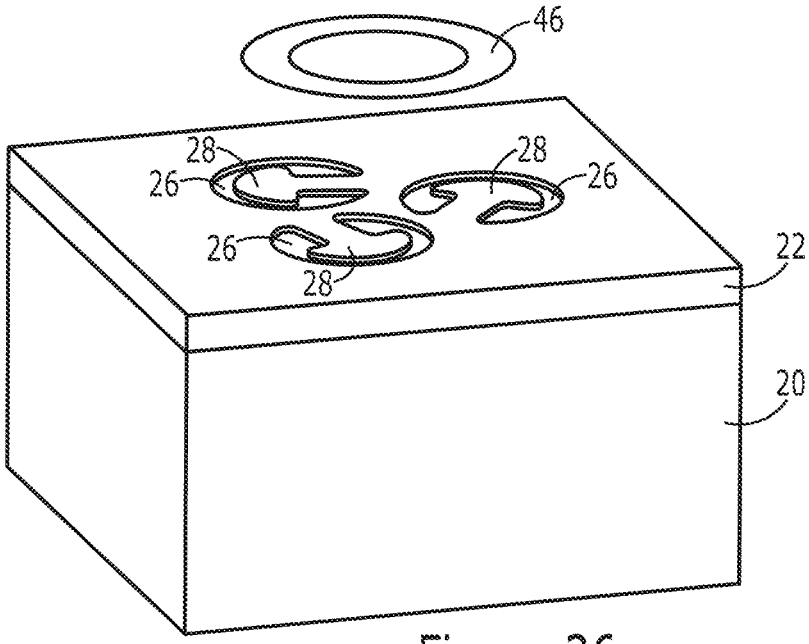
Figure 27:
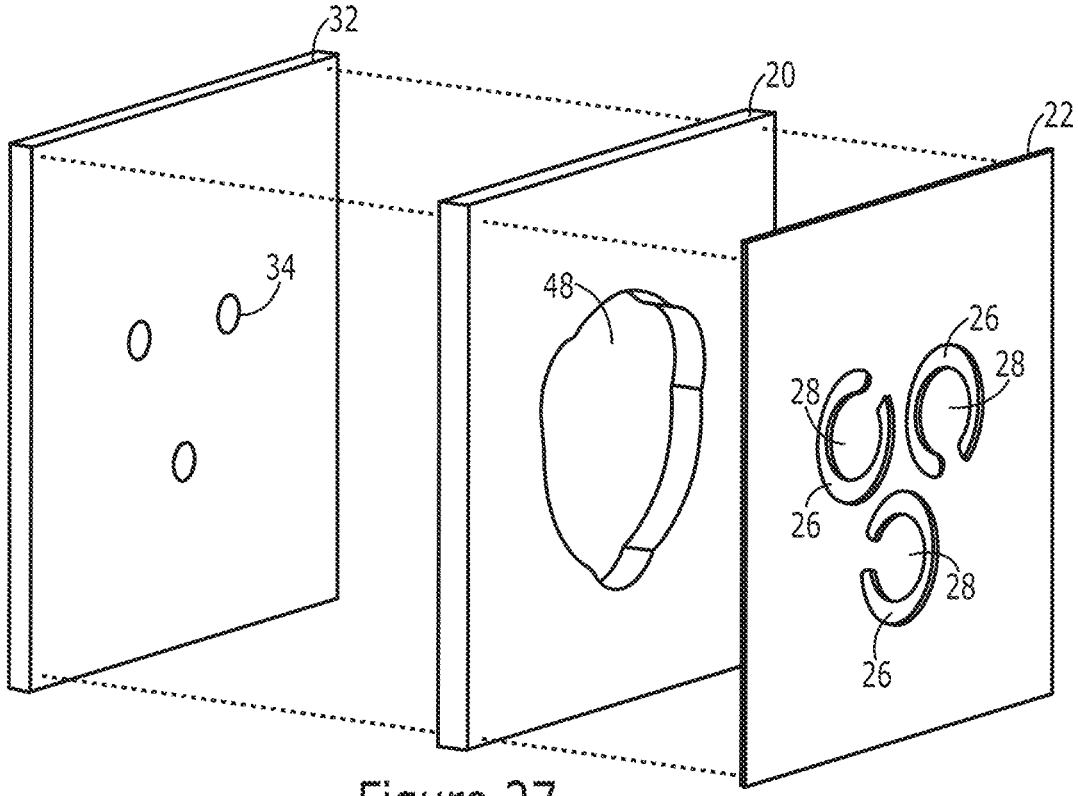
Figure 28:
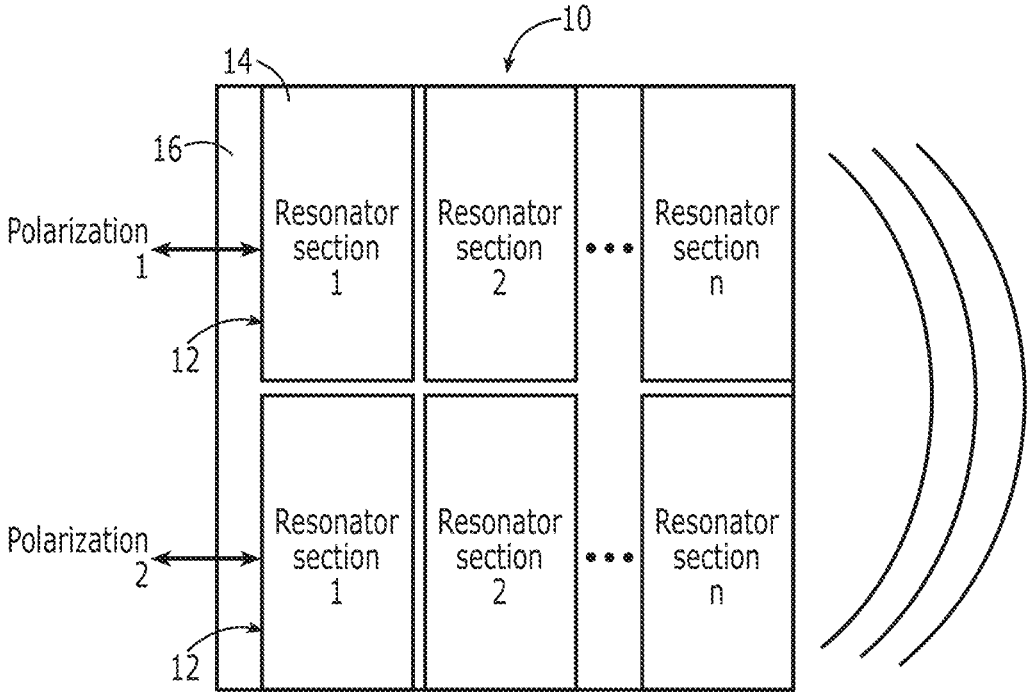
Figure 29:
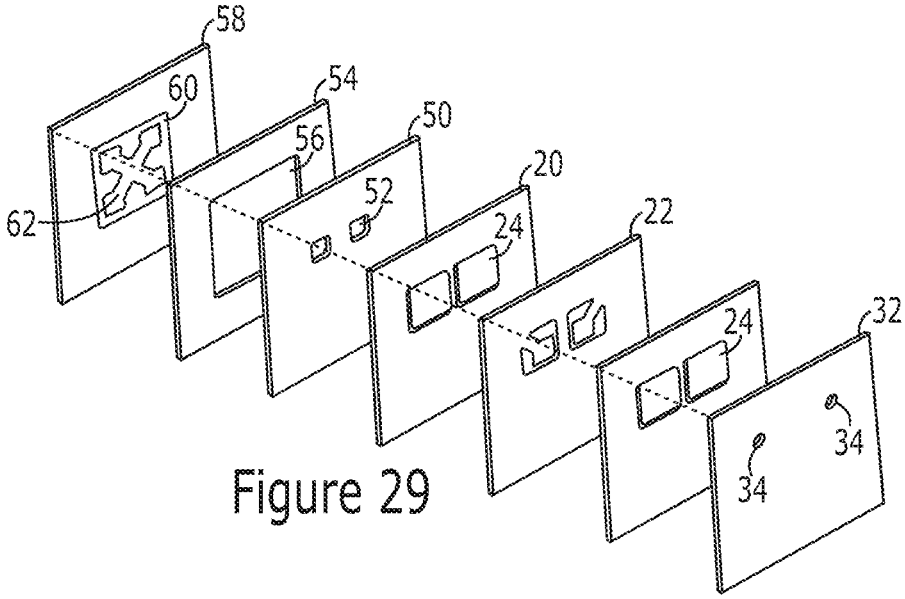
Figure 30:
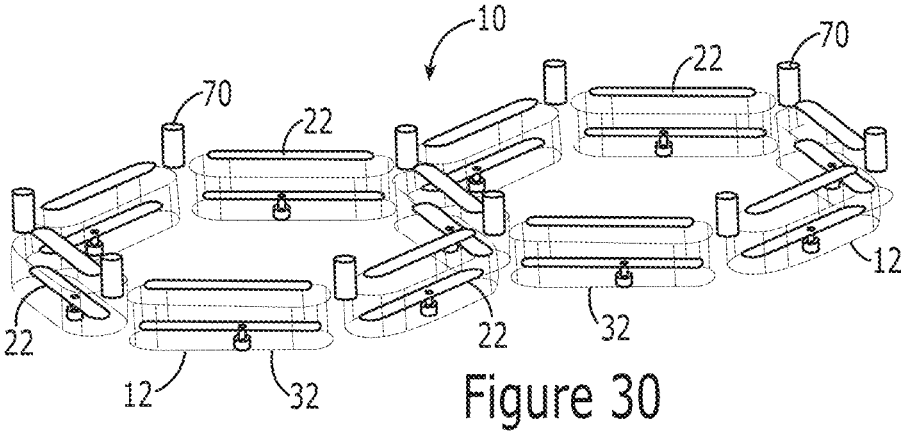
Figure 31:
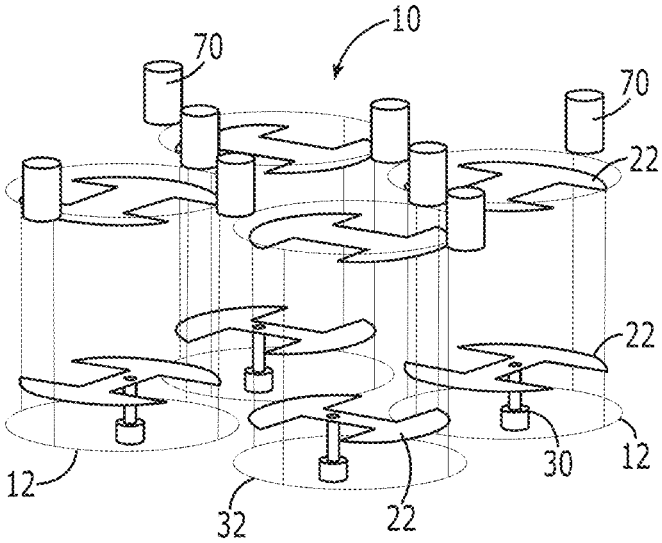

FIGS. 16*a* and 16*b* are diagrams representing the absolute value of the far field radiation patterns generated by the ports of the first and second filtennas, respectively, of a dual mode radiator in accordance with an example embodiment of the present disclosure;

FIGS. 17*a* and 17*b* depict the phase of the theta and phi far field radiation pattern components, respectively, generated by the port of a first filtenna of a dual mode radiator in accordance with an example embodiment of the present disclosure;

FIGS. 18*a* and 18*b* depict the phase of the theta and phi far field radiation pattern components, respectively, generated by the port of a second filtenna of a dual mode radiator in accordance with an example embodiment of the present disclosure;

FIGS. 19*a*-19*e* depict the far field radiation pattern as the phase progresses from 0° to 180° for the port of a second filtenna of a dual mode radiator in accordance with an example embodiment of the present disclosure;

FIG. 20 is a perspective view of a half wavelength dipole positioned in alignment with two quarter wave resonators of a dual mode radiator in accordance with an example embodiment of the present disclosure;

FIG. 21 is an exploded perspective view of a multi-filtenna system having three filtennas in accordance with an example embodiment of the present disclosure;

FIG. 22 is a graphical representation of the coupling between the second to last resonators and the plurality of modes generated by the multi-filtenna system of FIG. 21;

FIGS. 23*a*, 23*b* and 23*c* depict the far field radiation pattern generated by the first, second and third ports, respectively, of the triple-mode radiator of FIG. 21;

FIGS. 24*a*, 24*b* and 24*c* depict the far field radiation patterns of the monopole, the circularly polarized and the linearly polarized modes of the triple-mode radiator of FIG. 21;

FIG. 25 is a graphical representation of the S-parameters of the multi-filtenna system of FIG. 21;

FIG. 26 is a perspective view of a dual-mode half wavelength ring positioned in alignment with center portions of three quarter wave resonators of a triple-mode radiator in accordance with an example embodiment of the present disclosure;

FIG. 27 is an exploded perspective view of a base and first resonator sections of a multi-filtenna system having three of filtennas in which the cavities defined by the waveguide sections of the first resonator section are merged to form a common cavity in accordance with an example embodiment of the present disclosure;

FIG. 28 represents a multi-filtenna system in accordance with another example embodiment of the present disclosure;

FIG. 29 is an exploded view of a filtenna in accordance with the multi-filtenna system of FIG. 28;

FIG. 30 depicts a multi-filtenna system in accordance with a further example embodiment of the present disclosure; and FIG. 31 depicts a multi-filtenna system in accordance with yet another example embodiment of the present disclosure.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

A multi-filtenna system is provided that integrates antenna and filter functionality in a compact design, while providing performance improvements, such as adequate port isolation, a low ECC, a low insertion loss (and a corresponding high efficiency) and a similar radiation pattern for each antenna element in order to allow for multi-channel beam forming. Referring to FIG. 1, a multi-filtenna system 10 is depicted in accordance with an example embodiment. The multi-filtenna system of FIG. 1 includes an integer number n of filtennas 12 disposed proximate one another. The filtennas may be spaced from one another by different distances, but are generally spaced from one another by a spacing within the range of one half wavelength at the resonant frequency (or an integer multiple thereof) to three quarters wavelength at the resonant frequency (or an integer multiple thereof) in order to balance between under-sampling the radiating waves (which would occur if the filtennas were spaced further apart and woul limit the beam-steering angle due to side-lobes) and mutual coupling between filtennas (which would occur if the filtennas were spaced too close together and may result in increased correlation between filtennas and limitations upon the MIMO performance). Additionally, the filtennas of an example embodiment are disposed in a mutually parallel relationship.

The multi-filtenna system 10 of FIG. 1 includes any number of filtennas, such as two filtennas, three filtennas, four filtennas, five filtennas or the like. Generally, the performance improves as the number of filtennas increases. In this regard, as the number of filtennas increase, the beamforming gain in any particular direction increases, thereby increasing the signal-to-noise ratio. Also, as the number of filtennas increase, the number of MIMO channels increases such that the link bandwidth also increases. However, an increase in the number of filtennas generally also increases the size and cost, which may be disadvantageous in at least some applications. Each filtenna includes one or more resonator sections 14 coupled to one another in series in an end-to-end configuration. Each filtenna may include the same number of resonator sections or different numbers of resonator sections relative to other filtennas of the multi-filtenna system. Moreover, although each filtenna of the multi-filtenna system of FIG. 1 includes three resonator sections, the filtennas may include different numbers of resonator sections, such as one resonator section, two resonator sections, four resonator sections or more. The resonator sections may be configured to define different poles and correspondingly increase filter selectivity. Thus, the number of resonator sections may, in some embodiments, define the number poles of the filtenna. Thus, the filtenna in an example embodiment has the same number of poles as the number of resonator sections, such that a filtenna having three resonator sections has three poles in an example embodiment.

The multi-filtenna system 10 of FIG. 1, includes a feed cavity 16. The feed cavity defines a plurality of ports, one of which feeds each respective filtenna 12. Although a common feed cavity is depicted that defines all of the ports for all of the filtennas of the multi-filtenna system, the multi-filtenna system may include a plurality of feed cavities, one of which is associated with each filtenna. In a transmitter configuration, the feed ports of the multi-filtenna system are driven by electronic signals provided by a transmitter. In one embodiment, a single transmitter provides electronic signals to each of the feed ports of the multi-filtenna system via a feed network, such as a Butler matrix. In this embodiment, the transmitter may provide a single channel or signal, but the phase and amplitude of the signal may be either switched between a predefined number of beams or digitally controlled, such as with programmable phase shifters, to have a plurality of possible beams. Alternatively, each feed port of the multi-filtenna system may be driven by a separate transmitter. In this embodiment that includes a plurality of transmitters, a plurality of separate channels may be provided or a single channel may be provided with active beamforming. Still further, a plurality of channels, less than the number of filtennas of the multi-filtenna system, may be provided, each with a subset of beamforming. In this example embodiment, the multi-filtenna system of an example embodiment may be driven by a plurality of transmitters, albeit a smaller number of transmitters than the number of filtennas. Consequently, one or more of the transmitters may be connected to multiple filtennas via a feed network as described above. The multi-filtenna system may therefore include a common feed port, a plurality of feed ports with a separate feed port for each antenna or a plurality of feed ports, albeit less than the number of filtennas. Although described in conjunction with a transmitter configuration, the multi-filtenna system may alternatively or additionally be configured in a receiver configuration so as to receive electromagnetic signals and to transform the electromagnetic signals into electronic signals provided to one or more receivers in a comparable manner to that described above with respect to one or more transmitters. The transmitter and receiver configurations may also be combined with the multi-filtenna system being in communication with one or more transceivers. Thus, the ports will be referenced hereinafter as feed ports and the cavity that houses the ports will be referenced as a feed cavity for purposes of example, but not as a limitation, as the ports and the corresponding cavity may, instead, serve to communicate signals received by the multi-filtenna system to a receiver, a transceiver or the like. As used herein, "feed", as in a feed port, or "fed" refer generally to a connection between two components to enable RF signals to be communicated between the two components without substantial RF losses. Thus, a feed may be a connection which communicates an RF signal to a further component from a first component, or a feed may be a connection that receives an RF signal from a further component and passes the signal to the first component.

The multi-filtenna system 10 of FIG. 1 also optionally includes a mode balancing structure 18, such as a parasitic mode-balancing structure. In some, but not all embodiments, the mode balancing structure is disposed opposite the feed cavity 16 with respect to the one or more resonator sections 14, that is, with the one or more resonator sections disposed between the feed cavity and the mode balancing structure. The mode-balancing structure may be configured in various manners including, for example, in the form of a common cavity and/or as one or more antenna elements disposed in an aligned relationship with a radiating element, as described below.

Although the filtennas 12 of the multi-filtenna system 10 may be configured in various manners, one example of a filtenna is depicted in FIG. 2. The filtenna of FIG. 2 includes three resonator sections 14 configured to define a three pole filter. As noted above, however, the filtenna may include any number of resonator sections in other embodiments. Each resonator section includes a waveguide section 20 and a resonator 22 disposed proximate, such as adjacent, the waveguide section. Each waveguide section of an example embodiment is formed by a sheet of material, such as a conductive material, e.g., a metal or metal alloy, such as and not limited to at least one of: copper, brass, bronze, aluminum, nickel, gold, silver and nickel iron. The sheet of material defines a cavity 24 therethrough. The cavity may have various shapes and sizes. In one example embodiment, the cavity has a circular shape as depicted in FIG. 2. Alternatively, the cavity may have a polygonal shape, such as a rectangular or hexagonal shape. The resonator of a respective resonator section also defines an opening 26 therethrough and is positioned relative to the respective waveguide section such that the opening defined by the resonator and the cavity defined by the waveguide section are aligned. Although the opening defined by the resonator may be defined in different manners so as to have different resonant characteristics, the resonator of the example depicted in FIG. 2 defines an opening having the same size and the same shape as the waveguide section. The opening is defined by the resonator so as to have a resonant element 28 extending into the opening. The resonant element may also have various shapes and sizes, depending upon the resonant characteristics of the resonator. In the illustrated embodiment, however, the resonator defines a C-shaped opening having an exterior shape and size that corresponds to, that is, matches the size and shape of the opening defined by the corresponding waveguide section and that defines a mushroom-shaped resonant element extending into the opening.

The waveguide section 20 of each resonator section 14 of a filtenna 12 may define a cavity 24 having the same shape and size. Similarly, the resonator 22 of each resonator section of a filtenna may define an opening 26 having the same shape and size and including a resonant element 28 having the same size and shape. The sheets defining the waveguide sections and the resonators may be stacked in an alternating configuration with a waveguide section proximate the feed port followed by a resonator. The sheets defining the waveguide sections and the resonators may be stacked such that the sheets are adjacent and in contact with one another. The sheets may contact one another so that a direct current (DC) electrical connection is established between each adjacent sheet such that a DC current could flow from the first sheet to the nth sheet in a stack of sheets. In other words, a galvanic connection is established between each sheet and an adjacently disposed sheet. The cavities defined by the waveguide sections of the resonator sections are at least partially aligned and, in one embodiment, are fully aligned. Similarly, the openings defined by the resonators are also at least partially aligned and, in one embodiment, are fully aligned, both with the openings defined by other resonators and with the cavities defined by the waveguide sections.

Each resonator 22 of a filtenna 12 of an example embodiment has the same thickness. The thickness, in one example embodiment, is a quarter wavelength at the resonant frequency of the multi-filtenna system 10 (or an integer of multiple thereof). In one embodiment, the resonators of each of the filtennas of the multi-filtenna system are resonant at the same center frequency. The waveguide sections defined by respective sheets may have the same thickness or the waveguide sections may have different thicknesses. The thickness of a waveguide section defines the amount of coupling between the resonators on opposite sides of the respective waveguide section. As shown in the embodiment of FIG. 2, the waveguide sections have different thicknesses $T_1$, $T_2$, $T_3$ with the thicknesses of the waveguide sections serving to define the relative locations of the poles of the multi-filtenna system as a result of different amounts of coupling between the resonators provided by waveguide sections of different thicknesses.

In an example embodiment, the sheets that define the waveguide sections 20 and the resonators 22 are pressed together to form an in-line waveguide tube with periodically embedded quarter wave resonators. The plurality of sheets may be clamped, bonded or soldered together to form a monolithic structure.

A filtenna 12 communicates via a pin 30 and, in a transmitter configuration, is fed by a feed pin that extends through the cavity 24 defined by a first waveguide section 20 and physically contacts the resonant element 28 of a first resonator 22. See, for example, FIG. 3. The amount of input coupling of the feed pin to the resonator is dependent upon the location at which the pin contacts the resonant element with increased coupling provided as the pin contacts the resonant element at a location further away from the peripheral frame of the resonator that defines the opening 26 and less coupling provided as the pin contacts the resonant element at a location closer to the peripheral frame of the resonator that defines the opening.

In an example embodiment depicted in FIG. 2, the filtenna 12 includes a base 32 formed by a sheet of material, such as conductive material, e.g., a metal, that defines a hole 34 therethrough. The hole is sized to receive the feed pin 30 and is located such that the feed pin extends therethrough and contacts the resonant element 28 at the desired location. Although the filtenna may be fed with various types of feed pins, the feed pin of an example embodiment is provided by the center pin of a coaxial cable that extends through the hole defined by the base and into contact with the resonant element.

The filtenna 12 also includes a radiating resonator 36. The radiating resonator is disposed opposite the base 32 relative to the one or more resonator sections 14. The radiating resonator may be different, and in addition to, the resonators 22 of the resonator sections 14. Alternatively, the resonator of one of the resonator sections, such as the resonator section furthest from the base, may also serve as the radiating resonator. In an instance in which the radiating resonator is a different element than the resonators of the resonator sections, the radiating resonator may be configured in the same manner as the resonators of the resonator sections. For example, the radiating resonator may define an opening, such as a C-shaped opening, with a resonant element, such as a mushroom-shaped radiating element, extending therein. Additionally, the radiating resonator may have the same thickness as the resonators of the resonator sections, such as a quarter wavelength at the resonant frequency (or an integer multiple thereof).

In operation, the base 32, the one or more resonator sections 14 and the radiating resonator 36 may be grounded. In a transmitter configuration, a signal may be introduced via the feed pin 30 such that radio frequency (RF) energy is coupled into the first resonator section. As shown in FIG. 4, the first resonator section R1 receives energy from the feed pin P1 and couples energy to the second resonator section R2 which, in turn, couples energy to the third resonator section R3 and so on. The final resonator section, such as the third resonator section in the example embodiment of FIG. 2, is proximate the open end of the waveguide such that electromagnetic signals are radiated via the radiating resonator into free space. By way of example, the far field radiation pattern diagram of a 3-pole filtenna, such as shown in FIG. 2, is depicted in FIG. 5. The far field radiation pattern diagram of FIG. 5 is substantially hemi-spherically isotropic, albeit with a reduction of a few decibels in gain along the Y-axis. Conversely, in a receiver configuration, the radiating resonator receives electromagnetic signals that are then coupled from the third resonator section R3, to the second resonator section R2 and then to the first resonator section R1 prior to communication via the port to a receiver.

The operational characteristics of the multi-filtenna system 10 may be tailored based upon the configuration of the components of the filtennas 12. In this regard, the multi-filtenna system may be configured to operate at various frequencies or within various frequency bands. Since the filtennas are spaced apart by at least a half wavelength of the resonant frequency, the size of the multi-filtenna system scales with the frequency. The bandwidth of the multi-filtenna system of an example embodiment is limited by at least the Chu Harrington limit and may, in some embodiments have a bandwidth that is limited to about a 10% fractional bandwidth. For example, the resonant frequency of a filtenna may be controlled based upon the diameter of the cavities 24 defined by the waveguide sections 20 with waveguide sections defining cavities of a larger diameter having a lower resonant frequency than waveguide sections defining cavities having a smaller diameter. Additionally or alternatively, the resonant frequency of the filtenna may be controlled by the width of the base 32 with a thinner base providing for lower resonant frequencies than a thicker base due to a change in impedance altering the resonator inductance. Still further, the resonant frequency of a filtenna that includes a quarter wave resonator extending laterally from a side wall of the filtenna may be controlled based upon the gap from the quarter wave open end to the ground opposite with a smaller gap providing for lower resonant frequencies than a larger gap due to a change in the resonator capacitance. In this embodiment, the quarter wave resonator is grounded at one end and open at the other end and has a length equal to an integer multiple of a quarter of the wavelength of the resonant frequency of the filtenna. The grounded end of the quarter wave resonator is physically and electrically connected to the filtenna, while the open end is opposite the grounded end. An air gap, typically a small air gap, is defined between the open end of the quarter wave resonator and the opposite side wall of the filtenna. The size of the gap is defined from the open end of the quarter wave resonator to the closest side wall of the filtenna.

In addition, the radiated bandwidth or external Q of the radiating resonator 36 is defined by the distance from the radiating resonator to the open end of the waveguide. In the illustrated embodiment, the radiating resonator is disposed at the open end of the waveguide and, as such, the bandwidth of the filtenna 12 is maximized. Further, the radiating bandwidth is dependent upon the diameter of the waveguide. In this regard, the radiating bandwidth may be increased by increasing the diameter of the cavities 24 defined by the waveguide sections 20 or, conversely, the radiated bandwidth may be decreased by decreasing the diameter of the cavities defined by the waveguide sections. In an example embodiment, the bandwidth of each channel or each feed port may be increased by increasing the radiating bandwidth of all modes and/or by increasing the number of additional resonators 22. As shown in FIG. 6, the Chebyshev shape return loss of a 3 pole filtenna, such as shown in FIG. 2, is depicted. The center frequency is 3.5 GHz and the bandwidth is approximately 100 MHz.

As described above in conjunction with FIG. 1, the multi-filtenna system 10 includes a plurality of filtennas 12 proximate one another, such as with a half wavelength spacing therebetween as designated $\lambda/2$ in FIG. 1, and extending, in one embodiment, in parallel with one another. Each of the filtennas is configured to operate at the same frequency. Although the plurality of filtennas may each be defined by discrete waveguides, such as shown in FIG. 2, positioned proximate one another, corresponding elements of the plurality of filtennas may be defined by the same sheets of material, such as shown in FIG. 7. In this regard, FIG. 7 depicts a portion of a multi-filtenna system including two filtennas. The portion of each filtenna that is illustrated includes a base 32 and a resonator section 14. Although not shown, each filtenna may also include additional resonator sections and a radiating resonator 36. For a respective resonator section of each of the plurality of filtennas, a first monolithic sheet defines the cavities of the waveguide sections for each of the plurality of filtennas and a second monolithic sheet defines the resonators for each of the plurality of filtennas. Thus, the first monolithic sheet defines two cavities for the two waveguide sections of the two filtennas and the second monolithic sheet defines the two resonators for the two filtennas. In an example embodiment, the spacing between the central axis defined by the cavity of the waveguide section of one filtenna relative to the central axis of the cavity of the waveguide section of the other filtenna is approximately a half wavelength at the resonant frequency (or an integer multiple thereof). The multi-filtenna system of this example embodiment includes a single base defining a feed port 34 for each of the two filtennas. Although the multi-filtenna system of FIG. 7 includes two filtennas, the multi-filtenna system may include other numbers of filtennas, such as three filtennas as described below.

In an embodiment in which a multi-filtenna system 10 includes two filtennas 12 as shown in FIG. 7, the response of the resonators 22 is depicted in FIGS. 8-10 to illustrate the effect brought about by the orientation of the resonant elements 28 within the openings 26 defined by the resonators. In FIG. 8*a*, the resonator elements are positioned relative to the openings defined by the resonators with the grounded bases of the resonant elements facing one another. The pair of resonators provide two modes of radiation; one mode when the resonators are driven in phase, termed the [0 0] mode, and the other mode when the resonators are driven out of phase, termed the [0 180] mode. FIGS. 11*a* and 11*b* depict the two mode with FIG. 11*a* depicting the far field radiation pattern diagram generated by a pair of quarter wave resonators when driven in phase, that is, the [0 0] mode, and FIG. 11*b* depicting the far field radiation pattern diagram generated by the pair of quarter wave resonators when driven out of phase, that is, the [0 180] mode.

With reference now to FIG. 8*b* which depicts the S-parameters of the pair of quarter wave resonators 22 of FIG. 8*a*, the return loss S11 of the feed port of a first filtenna 12 has two distinct dips. Because of symmetry, the return loss S22 of the feed port of a second filtenna will be identical to that of the first filtenna. Each of these dips corresponds to one of the modes of radiation. The return loss of mode [0 0] is shown in magenta and the return loss of mode [0 180] is shown in black. The lower frequency S11 dip is generated primarily by mode [0 0] and the high frequency S11 dip is primarily generated by mode [0 180]. The amount of energy that exits the feed port of the second filtenna when the feed port of the first filtenna is driven is shown as S-parameter S21. The level of S21 is reduced by only 5 to 7 decibels across the band. As such, a significant fraction of the energy that should be radiated is lost from the feed port of the second filtenna, thereby signifying a low efficiency radiator.

With respect to this relatively large S21 S-parameter, reference is made to FIG. 12 in which each feed port P1, P2 is coupled to both radiation modes M1, M2 simultaneously, in parallel. In FIG. 12, mode M1 is mode [0 0] and mode M2 is mode [0 180]. As shown in FIG. 12, there are two coupling paths from the feed port P1 of the first filtenna 12 to the feed port P2 of the second filtenna through each radiating mode. The path through mode M1 is in phase such that coupling to and from mode M1 are of the same sign. However, the path through mode M2 is out of phase such that the coupling to and from mode M2 are of opposite signs. Assuming all couplings are equal in magnitude, the coupling path through mode M1 should cancel the coupling path through mode M2. However, this condition only occurs when the frequencies of modes M1 and M2 are substantially identical. When the radiating modes are at different frequencies, one mode will always be dominating, which means one coupling path will also always dominate. As such, to decrease the level of the S21 parameter and to improve the antenna efficiency, the frequencies of the mode [0 0] and mode [0 180] are brought together so as to have similar values and, in one embodiment, are identical.

Referring now to FIG. 9*a*, the pair of quarter wave resonators 22 are oriented relative to those depicted in FIG. 8*a* by 180° about the center of the opening 26 such that the open ends of the resonators now face one another. With reference to FIG. 9*b*, the S11 response of the resonators oriented as shown in FIG. 9*a* still shows two dips, although the low frequency dip now corresponds to mode [0 180], while the high frequency dip corresponds to mode [0 0]. As such, as the resonators rotate, there is an orientation at which mode [0 0] and mode [0 180] cross over in frequency. This orientation is approximately 38° of rotation in a counter-clockwise direction from the orientation depicted in FIG. 8*a* and is depicted in FIG. 10*a*. As shown in FIG. 10*b*, the corresponding S-parameters for the pair of quarter wave resonators of FIG. 10*a* depict the S11 parameter to have a single dip as mode [0 0] and mode [0 180] are coincident and the S21 parameter is reduced by more than 10 decibels. Referring again to FIG. 12, if all couplings are of equal magnitude and modes M1 and M2 are of equal frequency, the two coupling paths between port P1 and port P2 will only perfectly cancel out if the radiation bandwidths of modes M1 and M2 are also equal. When the radiation bandwidths of modes M1 and M2 are not equal, one radiating mode will dominate and allow unwanted signals to pass between port P1 and port P2. The difference between the coupling bandwidths of mode [0 0] and mode [0 180] is relatively small as shown in FIG. 10*b*. In order to highlight this relatively small difference, the difference between the coupling bandwidths of mode [0 0] and mode [0 180] is also depicted by the polar plot of FIG. 13. FIG. 13 more clearly depicts that mode [0 0] is under coupled such that the port is not feeding enough bandwidth to match the relatively strong radiating mode and mode [0 180] is over coupled such that the port is feeding too much bandwidth to match the relatively weak radiating mode. Additionally, S11 is critically coupled, as S11 extends through 0, which means that port P1 is perfectly matched to the superposition of mode [0 0] and mode [0 180]. Thus, to further decrease the S21 parameter, the radiating bandwidths of mode [0 0] and mode [0 180] must be brought together. Although a further reduction in the S21 parameter will not significantly improve the efficiency of the multi-filtenna system 10, the matching of the radiating bandwidths for each radiating mode serves to maintain a stable filtering function across all port phasing combinations. In contrast, when the radiating modes are not matched, such as due to even a slight mismatch as shown in FIG. 10*b*, the return loss shifts as the port phasing changes. Mode [0 0] and mode [0 180] represent the extremes of the available port phasing so any combination within this range, such as mode [0 45] will not distort the return loss of as severely. However, as the number of poles increases, the sensitivity to mode mismatch increases and the return loss may go out of tolerance as the ports are phased.

In order to lower the S21 S-parameter, such as from that shown in FIG. 10*b*, the radiating bandwidth in mode [0 0] is decreased relative to the radiating bandwidth in mode [0 180]. The relative decrease in the radiating bandwidth of mode [0 0] with respect to mode [0 180] may be accomplished using any one of several techniques. For example, the radiating bandwidth of mode [0 0] may be decreased relative to the radiating bandwidth of mode [0 180] by the incorporation of a ground wall that encloses the openings 26 defined by the resonators 22 as shown in FIG. 14*a*. In this regard and as shown in FIG. 11*a*, mode [0 0] radiates dominantly in the x-y plane, while mode [0 180] radiates dominantly perpendicular to the x-y plane as shown in FIG. 11*b*. Thus, a ground wall element 38 that is grounded and encloses the resonators inhibits the radiating bandwidth in mode [0 0] without affecting the radiating bandwidth in mode [0 180] to the same degree. The ground wall element may be formed by a sheet of conductive material that defines an opening 40, such as a circular opening as shown in the embodiment of FIG. 14*a*. The opening defined by the ground wall element is large enough to surround each of openings defined by the plurality of resonators. When the thickness of the sheet is such that the ground wall element is of a critical height, the radiating bandwidths will become equal, such as in an instance in which the [0 0] radiating bandwidth equals the [0 180] radiating bandwidth, and the level of port-to-port coupling is minimized, such as to less than 50 decibels down as shown in FIG. 14*b*.

Even with the use of a ground wall element 38, residual S21 coupling still exists and is caused by the near fields of the feed pins overlapping. However, the polar plot of FIG. 15 shows a near perfect overlap of the S11 parameters for each mode. FIGS. 16*a* and 16*b* depict the absolute value of the far field radiation patterns generated by the feed ports of the first and second filtennas 12, respectively. In this regard, each feed port drives a superposition of mode [0 0] and mode [0 180] so that the amplitude of the far field radiation patterns are similar. However, the feed port of the second filtenna drives at 180° out of phase compared to the feed port of the first filtenna, so the phase of the theta and phi far field radiation pattern components are orthogonal as shown, for example, in FIGS. 17 and 18. In this regard, FIGS. 17*a* and 17*b* depict the phase of the theta and phi far field radiation pattern components, respectively, generated by the feed port of the first filtenna, while FIGS. 18*a* and 18*b* depict the phase of the theta and phi far field radiation pattern components, respectively, generated by the feed port of the second filtenna. Because the far field radiation patterns are orthogonal, the envelope correlation coefficient is zero, thereby implying a maximum MIMO capacity increase. Alternatively, the ports may be combined with various phase combinations to provide coarse beamforming capability. Five examples of the resulting far field radiation patterns as phase progresses from 0° to 180° for the feed port of the second filtenna are shown in FIGS. 19*a*-19*e*. Each of these phase combinations have identical S-parameters which, in turn, are the same S-parameters as shown in FIG. 14*b*.

In addition to or instead of a ground wall element 38, the mode radiating bandwidths may be balanced, such as by decreasing the radiating bandwidth of mode [0 0] relative to the radiating bandwidth of mode [0 180], in other manners. For example, in an embodiment in which the multi-filtenna system 10 includes a pair of filtennas 12, an antenna element, such as a half wavelength dipole 42, may be suspended as shown in FIG. 20 in alignment with the center portion of the sheet that extends between the openings 26 defined by the pair of quarter wave resonators 22 in order to serve as a parasitic mode balancing structure 18. The half wavelength dipole increases the bandwidth of mode [0 180], but is invisible to mode [0 0]. As such, the half wavelength dipole provides similar S21 levels to those shown in FIG. 14*b*. However, relative to the embodiment of FIG. 14*b*, the half wavelength dipole structure has the advantage of increased bandwidth as mode [0 180] is strengthened to match mode [0 0] rather than the mode [0 0] being weakened to match mode [0 180]. The half wavelength dipole maybe constructed in various manners. For example, the dipole could be printed on a circuit board and suspended relative to the two quarter wave resonators with one or more non-conductive posts, such as one or more plastic posts.

A further technique for balancing the mode radiating bandwidths, such as by decreasing the radiating bandwidth of mode [0 0] relative to the radiating bandwidth of mode [0 180], is depicted in FIG. 7. In this embodiment, cavities 24 defined by the respective waveguide sections 20 of the plurality of filtennas 12 are merged to form a common cavity, which serves as a parasitic mode balancing structure 18. For example, the cavities defined by the waveguide sections may be merged with a rectangular cut out 44 to form the common cavity. The common cavity formed by merging the cavities defined by the respective waveguide sections effectively suspends the central portion of the sheet defining the two quarter wave resonators 22, that is, the central portion between the two quarter wave resonators, thereby allowing increased radiating bandwidth of the mode [0 0]. This technique allows slightly increased bandwidth compared to the embodiment of FIG. 14, although the coupling from port-to-port is increased as the feed pins are exposed to each other to a greater degree.

Although described above in conjunction with a multi-filtenna system 10 that includes a pair of filtennas 12, the same techniques may be applied with respect to multi-filtenna systems having other numbers of filtennas, such as a multi-filtenna system having three filtennas. As shown in FIG. 21, the multi-filtenna system includes a base 32 defining three holes 34 through which feed pins are provided into the respective filtennas. The multi-filtenna system also includes two resonator sections 14 and parasitic mode balancing structure 18 in the form of a ground wall element 38. In the illustrated embodiment, the ground wall element defines an opening 40 that is sized and shaped to match the openings 26 defined by the resonators 22. In this regard, the opening defined by the ground wall has a single common opening that encompasses the openings defined by the resonators of each of the three filtennas.

With respect to a multi-filtenna system 10 having three filtennas 12, the additional mode in such a triple-mode radiator is the same mode as the [0 180] mode of a dual-mode radiator, but rotated 90° in the X-Y plane. Since the [0 180] mode in a dual-mode radiator is equivalent to a linearly polarized broadside dipole radiator, the three modes of a triple-mode radiator can be considered as a monopole radiator radiating in the X-Y plane combined with a dual-polarized patch antenna radiating two orthogonal broadside modes, perpendicular to the X-Y plane. As such, the three techniques described above for balancing the mode radiating bandwidth as applied to dual-mode radiator are also applicable to a triple-mode radiator.

FIG. 22 shows a coupling structure that models the triple-mode radiator of FIG. 21. The paths from any port to any other port cancel out when the mode frequencies and radiating bandwidths are equal. The last resonators 22 of the plurality of filtennas 12, that is, the resonators furthest from the base 32, form a multi-mode radiator with the modes M1, M2 and M3 orthogonal to each other, that is, the modes do not couple together. Each mode is distributed across the entire group of last resonators and there are as many modes as there are last resonators and, as a result, as many modes as the number of filtennas of the multi-filtenna system. The second to last resonator of each filtenna designated R1, R2 and R3 in FIG. 22 then effectively couples to all modes simultaneously, in parallel. Thus, there are paths of RF energy coupling each port to every other port. The frequencies of each mode and the radiative couplings (or external Q, or radiative bandwidth) of each mode can be configured to be equal such that the combination of coupling paths from each second to last resonator to any other second to last resonator through the multi-mode radiator cancel out due to the opposite phases of the multi-mode resonator. The isolation between any two ports in this example embodiment is therefore maximized in an instance in which the resonant frequency and radiating bandwidths of all modes are equal such that the modes cancel at all ports other than the driven port. Also, since each second to last resonator couples to all the radiating modes, the energy that radiates from any one port as its source is a superposition of all the modes. All ports then radiate similar amplitude radiation patterns, but their radiation phases are orthogonal. As such, the multi-filtenna system 10 provides for a near zero envelope correlation coefficient between any two ports, while also enabling multi-channel beamforming. Further, the cavity structure of each resonator of multi-filtenna system distributes the current and provides low insertion loss.

FIGS. 23*a*, 23*b* and 23*c* depict the far field radiation patterns generated by the first, second and third ports, respectively, of the triple-mode radiator. Three orthogonal modes can be generated by feeding the ports with equal amplitudes either in phase in mode [0 0 0], 120° out of phase in a clockwise direction in mode [0 120 240] or 120° out of phase in an anti-clockwise direction in mode [0 −120 −240]. The [0 0 0] mode is the monopole mode, while the [0 120 240] and [0 −120 −240] modes are circularly polarized broadside modes, with one being left hand and the other one right hand circularly polarized. Alternatively, two linearly polarized modes could be generated instead of the two circularly polarized modes by driving one combination of ports with amplitude vector [1 0.5 0.5] and phase vector [0 180 180], and the other combination of ports with amplitude vector [0 1 1] and phase vector [~0 180] wherein ~ indicates that the phase of the first port is not definable (since the amplitude at the first port is 0. The far field radiation patterns of the monopole, the circularly polarized and the linearly polarized modes are shown in FIGS. 24*a*, 24*b* and 24*c*, respectively. The dual mode, whether circularly or linearly polarized, can be rotated to any orientation in the X-Y plane.

FIG. 25 depicts a frequency response of a multi-filtenna system 10 having three filtennas 12. The isolation between any two ports is 45 to almost 70 decibels, and the envelope correlation coefficient between any two ports is zero.

While the cavities 24 defined by the waveguide sections 20 may be of any shape, the hexagonally shaped cavities of the embodiment of FIG. 21 allows the maximum size for each waveguide and hence the maximum bandwidth for an embodiment in which the triple-mode filtenna system 10 is arranged in a triangular array. In one embodiment, the three triple-mode filtennas are arranged in a triangular array with 0.58 wavelength spacing, which is about optimal for a triangular array to maximize scanning angle while minimizing grating lobes.

As with the dual-mode radiator, the three frequencies of the triple-mode radiator can be brought together by rotating each resonator 22 about the center of the opening 26 defined thereby. Also, the three radiating bandwidths can be balanced utilizing the same techniques as described above with respect to the dual-mode radiator. In the embodiment of the triple-mode radiator shown in FIG. 21, a ground wall element 38 is provided proximate to the resonator of the second resonator section 14 in a similar manner to the ground wall element of FIG. 14*a* in order to reduce the radiating bandwidth of the monopole mode without the reducing the radiating bandwidth of the dual (circular or linear) polarized modes to any great extent.

Similar to the half wavelength dipole 42 positioned so as to be between the openings 26 defined by the two quarter wave resonators 22 of FIG. 20, FIG. 26 depicts an embodiment in which an antenna element, such as a dual-mode dipole half wavelength ring 46, is suspended above the centers of the openings defined by the three quarter wave resonators. As with the half wavelength dipole, the ring may be constructed in various manners, such as by being printed upon a printed circuit board and suspended, by one or more posts, such as one or more plastic posts, relative to the quarter wave resonators. The antenna element, such as the dual-mode dipole half wavelength ring, serves as a parasitic mode balancing structure 18 with the ring reinforcing and widening the bandwidth of the dual polarized modes while having negligible effect upon on the monopole mode. In an alternative embodiment, FIG. 27 depicts the cavities defined by the three waveguide sections 20 of the three filtennas 12 of a multi-filtenna system 10 being merged to define a common cavity 48 aligned with the openings of the resonators. The common cavity relieves from ground the section of the sheet that defines the resonators that lies between the three resonators and, as a result, increases the radiating bandwidth of the dual polarized mode while not substantially effecting the monopole mode.

The multi-filtenna system 10 may be configured in a variety of different manners. As shown in FIG. 28, for example, a multi-filtenna system is depicted that includes two filtennas 12, each comprised of three resonator sections 22. In a transmitter configuration, each filtenna is fed, such as via a feed port defined by a base 32, an input signal of a different polarization. As such, the resulting multi-filtenna system is a dual polarized, dual mode radiator. Alternatively, in a receiver configuration, each filtenna receives electromagnetic signals that then propagate through the resonator sections and are communicated, via the port defined by the base to a receiver.

As shown in FIG. 29, each filtenna 12 of the multi-filtenna system 10 of the embodiment of FIG. 28 includes a base 32 defining a hole 34 for each filtenna through which the respective filtennas are fed. Each filtenna also includes one or more resonator sections 14, each resonator section including a waveguide section 20 defining a cavity 24 and a resonator 22. Each filtenna further includes a second waveguide section 50 followed by a coupling iris 52, a radiator cavity 54 and a dual polarized radiator 56. The coupling iris localizes the coupling between a resonator and one mode of the dual polarized filtenna system, thereby effectively reducing the coupling between the resonators and improving port-to-port isolation. The coupling iris defines an opening 58 in alignment with, but smaller than the cavity defined by the second waveguide section, while the radiator cavity defines a larger opening 60 that surrounds the cavities defined by the second waveguide sections of each of the filtennas. The dual polarized radiator serves as the radiating resonator 36 in this example embodiment.

The dual-mode radiator provided by the embodiment of a multi-filtenna system 10 of FIGS. 28 and 29 utilizes a dual polarized radiator 56 made from a single patch. As such, the dual-mode radiator does not require a parasitic balancing structure to achieve good port-to-port isolation. Further, dual-mode radiator provides for the resonator to radiator coupling to be dominantly via the electric field.

Two additional embodiments of a multi-filtenna system 10 are shown in FIGS. 30 and 31 with the filtenna system of FIG. 30 including eleven filtennas 12 arranged in a FIG. 8 configuration and the filtenna system of FIG. 31 including four filtennas. Although each filtenna can include any number of resonator sections 14, the filtennas of the embodiments depicted in FIGS. 30 and 31 each include two resonator sections. For purposes of illustration, the waveguide section 20 of each resonator section is not depicted and, instead, the resonators 22 positioned proximate the waveguide sections are shown. In order to illustrate that the resonators may be differently embodied, the resonators of this example embodiment are half-wavelength dipole resonators, which provide for wider bandwidths than the quarter wavelength resonators of the other embodiments. Unlike the quarter wavelength resonators that defined C-shaped openings 26 therein, the half wavelength dipole resonators of FIGS. 30 and 31 are not grounded and, as such, are supported relative to the respective waveguide sections, such as by one or more non-conductive supports. The filtenna systems of FIGS. 30 and 31 also include parasitic mode balancing structures, such as in the form of rods 70 positioned between filtennas and extending outwardly therefrom.

The multi-filtenna systems 10 of FIGS. 30 and 31 may be formed of a plurality of sheets as described above. Alternatively, the multi-filtenna systems of FIGS. 30 and 31 may be formed of a single waveguide, such as may be milled from a single metal or metal alloy block with the resonators 22 inserted into the waveguide with non-conductive, e.g., dielectric, supports between each waveguide section 20.

The multi-filtenna system 10 of the foregoing embodiments may be embodied by a wide variety of radio communications equipment including, but not limited to, for example, one or more of: a transmitter, a receiver, a transceiver, an antenna, antenna array and an antenna mast. The radio communications equipment including the multi-filtenna system may be deployed in a variety of applications including a radar device or any of a variety of different networks including, but not limited to, for example, a stationary or mobile radio communications network, a satellite radio network, a power transmission network, a quantum computer or a quantum communications network.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A multi-filtenna system comprising:

a plurality of filtennas disposed in parallel proximate one another, wherein at least one filtenna comprises:

a base defining a port;

one or more resonator sections coupled to one another;

a ground wall element defining an opening aligned with a resonator of at least one of the resonator sections and configured to be grounded, wherein the ground wall element is disposed opposite the base relative to the resonator of the at least one resonator section; and a radiating resonator, wherein the one or more resonator sections are disposed between the port and the radiating resonator, wherein the plurality of filtennas are configured to communicate via the respective port and to operate at a same frequency.

2. A multi-filtenna system according to claim 1 wherein the at least one resonator section comprises a waveguide section defining a cavity therethrough, and wherein the resonator is adjacent the waveguide section.

3. A multi-filtenna system according to claim 2 wherein the resonator sections are stacked such that the cavities defined by the waveguide sections are at least partially aligned.

4. A multi-filtenna system according to claim 1 wherein the base is disposed proximate one end of the one or more resonator sections, opposite the radiating resonator.

5. A multi-filtenna system according to claim 4 wherein the at least one filtenna further comprises an antenna element disposed proximate the radiating resonator, opposite the base relative to the one or more resonator sections.

6. A multi-filtenna system according to claim 5 wherein the antenna element is aligned with a center portion of the radiating resonator.

7. A multi-filtenna system according to claim 2 wherein the cavities defined by respective waveguide sections of the plurality of filtennas are merged by a cutout section to define a common cavity.

8. A multi-filtenna system according to claim 2 wherein the cavities defined by the waveguide sections of at least one of the plurality of filtennas have a circular shape or a polygonal shape.

9. A multi-filtenna system according to claim 2 wherein for a respective resonator section of the plurality of filtennas, a first monolithic sheet defines the cavities of the waveguide sections for the plurality of filtennas and a second monolithic sheet defines the resonators for the plurality of filtennas.

10. A multi-filtenna system according to claim 1 wherein the plurality of filtennas are disposed in a parallel relationship.

11. A radio communications equipment comprising the multi-filtenna system of claim 1.

12. A multi-filtenna system comprising:

a plurality of filtennas disposed in parallel proximate one another, wherein each filtenna comprises a plurality of resonator sections, at least one resonator section comprising a waveguide section defining a cavity therethrough and a resonator adjacent the waveguide section, wherein the resonator sections are stacked such that the cavities defined by the waveguide sections are at least partially aligned, wherein at least one filtenna further comprises a base and a ground wall element defining an opening aligned with the resonator of at least one of the resonator sections and configured to be grounded, wherein the ground wall element is disposed opposite the base relative to the resonator of the at least one resonator section, and wherein the plurality of filtennas are configured to operate at a same frequency.

13. A multi-filtenna system according to claim 12 wherein the base defines a port disposed proximate one end of the plurality of resonator sections.

14. A multi-filtenna system according to claim 13 wherein the at least one filtenna further comprises a radiating resonator disposed proximate an opposite end of the plurality of resonator sections relative to the base.

15. A multi-filtenna system according to claim 14 wherein the at least one filtenna further comprises an antenna element disposed proximate the radiating resonator, opposite the base relative to the plurality of resonator sections.

16. A multi-filtenna system comprising:

a plurality of filtennas disposed in parallel proximate one another, wherein each filtenna comprises a plurality of resonator sections, at least one resonator section comprising a waveguide section defining a cavity therethrough and a resonator adjacent the waveguide section, wherein the resonator sections are stacked such that the cavities defined by the waveguide sections are at least partially aligned, wherein the cavities defined by respective waveguide sections of the plurality of filtennas are merged by a cutout section to define a common cavity, and wherein the plurality of filtennas are configured to operate at a same frequency.

17. A multi-filtenna system according to claim 12 wherein for a respective resonator section of the plurality of filtennas, a first monolithic sheet defines the cavities of the waveguide sections for the plurality of filtennas and a second monolithic sheet defines the resonators for the plurality of filtennas.

18. A radio communications equipment comprising the multi-filtenna system of claim 12.

19. A radio communications equipment comprising the multi-filtenna system of claim 16.

20. A multi-filtenna system according to claim 16 wherein at least one filtenna further comprises a base and a ground wall element defining an opening aligned with the resonator of at least one of the resonator sections and configured to be grounded, wherein the ground wall element is disposed opposite the base relative to the resonator of the at least one resonator section.

* * * * *